US005424168A

United States Patent [19]

Fujita et al.

[11] Patent Number: 5,424,168

[45] Date of Patent: Jun. 13, 1995

[54] CORE/SHELL DIRECT POSITIVE SILVER HALIDE EMULSION WITH SILVER HALIDE SOLVENT REMOVAL

[75] Inventors: Munehisa Fujita; Hiroyuki Asanuma, both of Kanagawa, Japan

[73] Assignee: Fuji Photo Film Co., Ltd., Kanagawa, Japan

[21] Appl. No.: 287,354

[22] Filed: Aug. 8, 1994

Related U.S. Application Data

[63] Continuation of Ser. No. 55,385, May 3, 1993, abandoned.

[30] Foreign Application Priority Data

May 11, 1992 [JP] Japan ..... 4-143705

[51] Int. Cl.[6] ..... G03C 8/10; G03C 1/015; G03C 1/10; G03C 1/485

[52] U.S. Cl. ..... 430/217; 430/569; 430/599; 430/567; 430/600; 430/603

[58] Field of Search ..... 430/217, 569, 599, 603, 430/567, 600

[56] References Cited

U.S. PATENT DOCUMENTS 4,665,017 5/1987 Mifune et al. ..... 430/603
4,678,745 7/1987 Yamada et al. ..... 430/569
4,801,524 1/1989 Mifune et al. ..... 430/569
4,845,023 7/1989 Mifune ..... 430/569
4,863,845 9/1989 Murai et al. ..... 430/569
5,030,552 7/1991 Iwasaki et al. ..... 430/569

*Primary Examiner*—Richard C. Schilling
*Attorney, Agent, or Firm*—Sughrue, Mion, Zinn, Macpeak & Seas

[57] ABSTRACT

There are disclosed an internal latent image type direct positive light-sensitive emulsions having improved spectral sensitization performance, and chemical sensitization performance, and color diffusion transfer photographic film units in which said emulsions are used. The emulsions are prepared by subjecting a silver halide grain, which forms an internal nucleus, to chemical sensitization, in the presence of an organic silver halide solvent, and adding a solid adsorbing agent, before finishing the formation of an outer shell silver halide phase, to remove a part or all of the silver halide solvent, wherein the emulsions may further contain a tabular silver halide grain having an average grain diameter of at least 0.3 μm and a ratio of an average grain diameter to an average grain thickness of 2 or more, based on 50% or more of the total silver halide grains.

4 Claims, No Drawings

CORE/SHELL DIRECT POSITIVE SILVER HALIDE EMULSION WITH SILVER HALIDE SOLVENT REMOVAL

This is a continuation of application Ser. No. 08/055 385 filed May 3, 1993, now abandoned.

FIELD OF THE INVENTION

The present invention relates to an internal latent image type direct positive silver halide emulsion and a color diffusion transfer photographic film unit incorporating such an emulsion.

BACKGROUND OF THE INVENTION

Photographic methods in which silver halide is used provide excellent sensitivity and gradation characteristics compared with other photographic methods, for example, electrophotographic methods and diazo photographic methods, and have widely been used up to now. Among silver halide photographic methods, a number of methods for forming a direct positive image are known. These methods allow one to obtain a positive image by providing uniform exposure, or by using a nucleus-forming agent in developing an internal latent image type direct positive silver halide emulsion in a "surface developing solution", i.e., a developing solution which leaves an internal latent image-forming site in a silver halide grain, without substantially developing the site as described, for example, in U.S. Pat. No. 3,761,276, and JP-B-60-55821 (the term "JP-B", as used herein, means an examined Japanese patent publication).

Such direct positive silver halide emulsions are better than negative type emulsions in terms of their capability to obtain a positive image in only one processing step.

In general, the internal latent image type direct positive silver halide emulsion can be prepared via the steps of mixing a soluble silver salt and a soluble halide in an aqueous solution of gelatin to form a silver halide grain (a core grain), followed by subjecting the core grain to a chemical sensitization, and then to a silver halide deposition for forming a shell, and then carrying out desalting, and a chemical sensitization, if such step is necessary.

The method for preparing an internal latent image type core/shell emulsion which is useful as a direct positive emulsion is described, for example, in JP-A-57-136641 (the term "JP-A", as used herein, means an unexamined published Japanese patent application). This method is characterized by the fact that the surface of the core/shell silver halide grain of the internal latent image type emulsion which contains silver halide grains comprising a silver halide internal nucleus (a core) which has been subjected to i) doping with a metal ion, ii) chemical sensitization, or iii) both of such the processings, and which contains a shell portion which covers at least a light-sensitive site in the internal nucleus, is subjected to chemical ripening in the presence of poly(N-vinyl pyrrolidone), poly(N-vinyl oxazolidone), the copolymer of vinyl alcohol and N-vinyl pyrrolidone, and the copolymer of N-vinyl pyrrolidone and vinyl acetate.

An internal latent image type emulsion which is useful as a direct positive emulsion is described as well in JP-B-52-34213 (U.S. Pat. No. 3,761,276). This emulsion is characterized by the fact that a doping agent is contained in the inside of a silver halide grain, and by the fact that the surface of grain is subjected to chemical sensitization. This is taught as well by U.S. Pat. No. 3,317,322 to Porter et al.

In such preparation methods, various additives used to be used. For example, the sulfur compounds, such as, the thione compounds described in JP-A-53-2408, and JP-A-53-144319, and the thioether compounds described in U.S. Pat. No. 3,574,628 are added during the formation of the silver halide grains to form the silver halide grains having a narrow grain size distribution (that is, a uniform grain size), and a fixed crystal form. These compounds are known as silver halide solvents, and are useful, since the use thereof in forming the internal latent image type core/shell silver halide grains can provide direct positive emulsions having hard gradation, and high sensitivity. Further, the use of sulfur compounds is effective, since the chemical sensitization of an internal nucleus (core) grain for a core/shell type silver halide grain with thione compounds, described in JP-A-55-29829, can effectively accelerate the action of a gold sensitizer which may be used in combination, and thus provide an internal latent image type core/shell silver halide emulsion of high sensitivity.

However, in some cases, additives necessary in the formation of a core grain, and for the chemical sensitization thereof, become unnecessary at the stage of silver halide deposition for forming a shell. For example, in the case of the above silver halide solvents, the grains are dissolved so as to become rounded because of the effect of the solvent on the grains, and, in some cases, the grains cannot be well formed when used in the formation of tabular grains. Further, in carrying out spectral sensitization by adding a sensitizing dye in the final stage for preparing an emulsion, trace amounts of silver halide solvent remaining on the surface of the emulsion grains prevents the sensitizing dye from being sufficiently adsorbent, so that the prescribed effect is not obtained.

The use of a deactivator (for example, hydrogen peroxide) against such a problem is disclosed in JP-A-61-3137, but the deactivator was not useful in cases where it adversely affected photographic performance. Further, there are disclosed in JP-A-61-219948, JP-A-61-219949, JP-A-62-23035, and JP-A-62-240951, emulsions in which chemical sensitizers, such as, gold compounds, and chemical sensitization aids, such as, azaindene, which remain after the preparation of an emulsion, are removed with an adsorbing substance, such as, an ion exchange resin, and an inorganic ion exchanger, but internal latent image type direct positive silver halide emulsions are not described therein. These patents relate to the disclosure of techniques aimed at the removal of unnecessary substances (substances exerting an adverse effects during storage of the emulsions) which remain, after the storage of emulsions, and they do not solve the above mentioned problems relating to emulsion preparation methods.

SUMMARY OF THE INVENTION

The object of the present invention is to provide an internal latent image type direct positive silver halide emulsion having an improved spectral sensitization performance, and chemical sensitization performance, and color diffusion transfer photographic film units in which such an emulsion is used, having high sensitivity and low minimum density.

To be more detailed, an object of the present invention is to provide an internal latent image type positive silver halide emulsion in which the spectral sensitization performance, and the chemical sensitization performance are improved by removing substances which prevent shell formation, chemical sensitization of the shell, and spectral sensitization by a sensitizing dye, before finishing silver halide deposition for forming an outer shell silver halide phase (hereinafter referred to as a "shell"), after subjecting a core grain to chemical sensitization during preparation of the internal latent image type direct positive silver halide emulsion, and to provide a color diffusion transfer photographic film unit, in which the above emulsion is used, having high sensitivity, and low minimum density.

The above objects of the present invention have been achieved by internal latent image type direct positive silver halide emulsions, as described in the following paragraphs (1) and (2), and in color diffusion transfer photographic film units in which the emulsions are used, as described in the following paragraph (3):

(1) an internal latent image type direct positive silver halide emulsion prepared by subjecting a silver halide grain, which forms an internal nucleus, to a chemical sensitization in the presence of an organic silver halide solvent, and adding a solid adsorbing agent, before finishing the formation of an outer shell silver halide phase, to remove a part or all of the organic silver halide solvent;

(2) the internal latent image type direct positive silver halide emulsion as described in paragraph (1), above, containing tabular silver halide grains having an average grain diameter of 0.3 μm or more, and a ratio of an average grain diameter to an average grain thickness of 2 or more by 50% or more based on the whole silver halide grains; and (3) a color diffusion transfer photographic film unit comprising (a) a light-sensitive sheet having an image-receiving layer, a white color reflection layer, a light shielding layer, and at least one silver halide emulsion layer combined with at least one dye image-forming material, each provided on a transparent support, (b) a transparent cover sheet having at least a neutralizing layer and a neutralization timing layer, each provided on a transparent support, and (c) a light shielding alkali processing composition spread between the above light-sensitive sheet, and the transparent cover sheet, wherein at least one layer of the above silver halide emulsion layers contains the internal latent image type direct positive silver halide emulsion, as described in paragraphs (1) and/or (2), above.

DETAILED DESCRIPTION OF THE INVENTION

The concrete details of the present invention will be explained below.

A solvent, useful as an organic silver halide solvent in the present invention, is a solvent which is prepared by adding the organic silver halide solvent to water, or water and an organic solvent (for example, water/methanol = 1/1) in a concentration of 0.02 mole, and which can dissolve a weight of silver chloride which exceeds twice the weight of silver chloride as is capable of being dissolved in water at the temperature of 60° C.

Concrete examples of particularly preferred organic silver halide solvents are sulfur-containing organic silver halide solvents, organic thioether compounds, thione compounds, and mercapto compounds. To be more concrete, there can be mentioned organic thioether derivatives, as described in JP-B-47-11386, the compounds described at pages 8 to 23 of Japanese Patent Application No. 58-232069 (JP-A-60-136736), the compounds described at pages 195 to 196 of JP-A-55 -77737, and the thioether compounds and thione compounds described in JP-A-53-824008 and JP-A-53-144319.

Some concrete examples of organic silver halide solvents useful in the present invention are as follows, but this invention is not limited thereto:

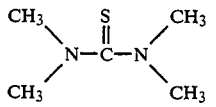
S-(1)

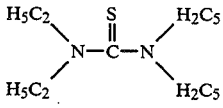
S-(2)

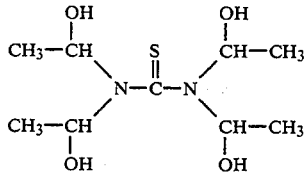
S-(3)

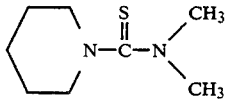
S-(4)

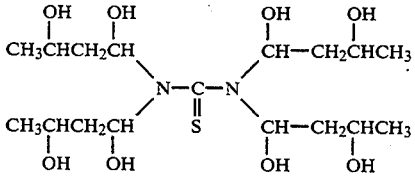
S-(5)

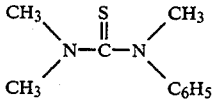
S-(6)

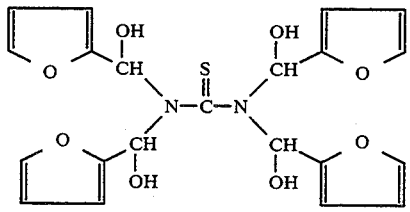
S-(7)

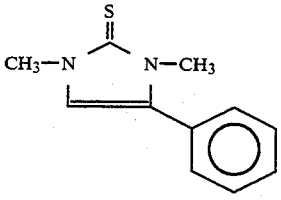
S-(8)

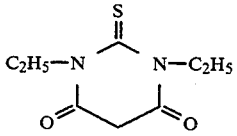
S-(9)

-continued
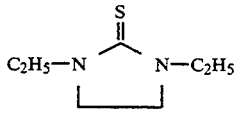
S-(10)
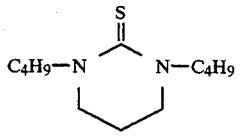
S-(11)
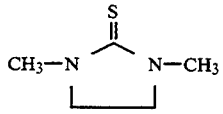
S-(12)
$HO(CH_2)_2—S—(CH_2)_2—S—(CH_2)_2OH$ S-(13)
$HO(CH_2)_3—S—(CH_2)_2—S—(CH_2)_3OH$ S-(14)
$HO(CH_2)_3—S—(CH_2)_2—S—(CH_2)_2—S—(CH_2)_2OH$ S-(15)
$[HO(CH_2)_2—S—(CH_2)_2—O—CH_2—]_2$ S-(16)
$[HO(CH_2)_5—S—(CH_2)_5—O—(CH_2)_2—]_2$ S-(17)
$[H_5C_2—O—(CH_2)_2—S—(CH_2)_2—]_2S$ S-(18)
$[H_3C—O—(CH_2)_4—S—(CH_2)_4—]_2S$ S-(19)
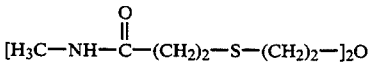
S-(20)
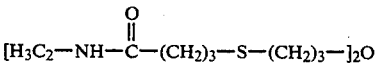
S-(21)
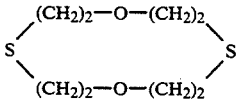
S-(22)
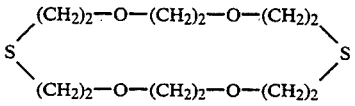
S-(23)
$[NH_2CO(CH_2)_2—S—(CH_2)_2CONH—CH_2—]_2$ S-(24)
$HOOC—CH_2—S—(CH_2)_2—S—CH_2—COOH$ S-(25)
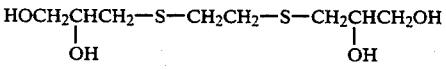
S-(26)
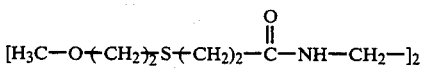
S-(27)
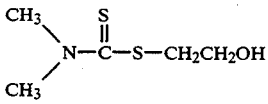
S-(28)
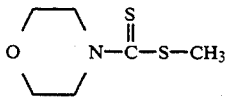
S-(29)
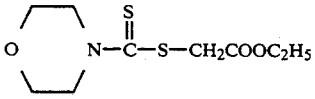
S-(30)
-continued
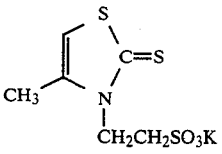
S-(31)
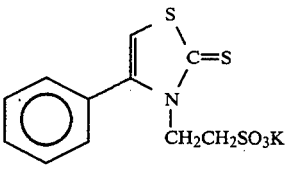
S-(32)
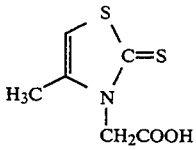
S-(33)
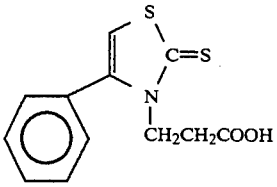
S-(34)
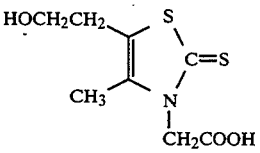
S-(35)
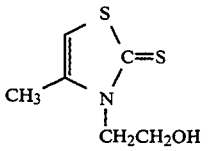
S-(36)
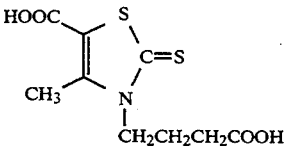
S-(37)
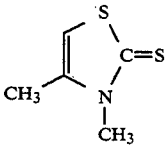
S-(38)
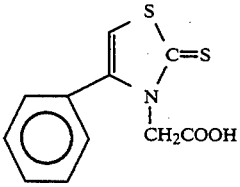
S-(39)

-continued

S-(40)

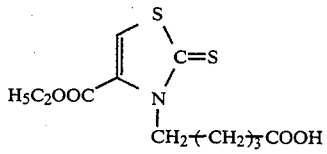

S-(41)

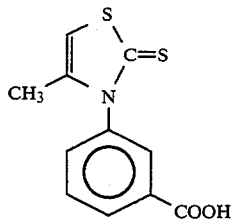

S-(42)

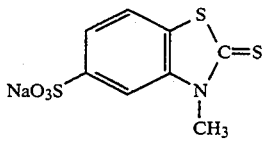

S-(43)

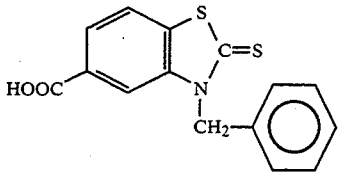

S-(44)

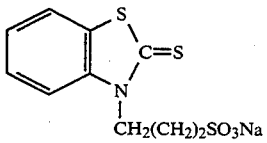

S-(45)

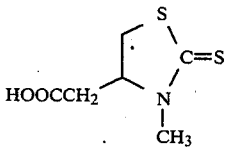

S-(46)

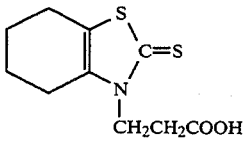

S-(47)

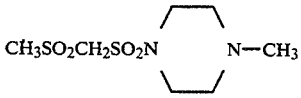

S-(48) $CH_3SO_2CH_2SOCH_3$

S-(49) $CH_3SO_2CH_2SO_2CH_3$

S-(50)

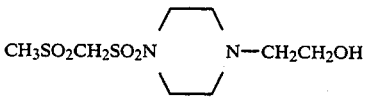

S-(51)

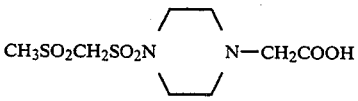

-continued

S-(52)

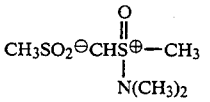

S-(53)

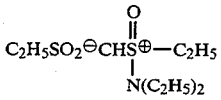

The concentration of the organic silver halide solvent used in chemical sensitization is preferably in the range of $10^{-5}$ to $10^{-1}$ mole per mole of silver halide contained in the core.

The silver halide contained in the core may be subjected to chemical sensitization by one or more kinds of noble metal sensitization, sulfur sensitization, and reduction sensitization. In particular, gold sensitization, and sulfur sensitization are provided to increase sensitivity.

The solid adsorbing agent described in the present invention is an inorganic or organic solid substance which is insoluble in water. To be concrete, examples thereof are (1) active carbon, (2) ion exchange resins, (3) porous resins, (4) porous organic synthetic resins having no ion exchange groups, and (5) inorganic adsorbing carriers.

To be concrete, an active carbon described as useful in the present invention is coconut shell active carbon; all of those active carbons described in "Active Carbon" edited by Carbon Material Association (Kohdansha, 1978) can also be used.

Illustrative ion exchange resins useful in the present invention include:

cation exchange resins: for example, ones sold under the trade names Amberlite IR-120 (manufactured by Rohm & Haas Co., Ltd.); Diaion (manufactured by Mitsubishi Chemicals Ind. Corp.) SK-1B, SK-102, SK-104, SK-106, SK-110, SK-112, SK-116, PK-206, PK-212, PK-216, PK-220, PK-228, WK-10, WK-11, and WK-20; and Powdex (a powdered resin) PCH;

anion exchange resins: for example, ones sold under the trade names Dowex 1×8 (manufactured by Dow Chemical Ltd.); Diaion (manufactured by Mitsubishi Chemicals Ind. Corp.) SA-10A, SA-11A, SA-12A, SA-20A, SA-21A, PA-306, PA-308, PA-312, PA-316, PA-318, PA-416, PA-408, PA-412, PA-416, PA-418, WA-10, WA-11, WA-20, WA-21, and WA-30; and Powdex (a powdered resin) PAO; and chelating resins: for example, ones sold under the trade names Diaion (manufactured by Mitsubishi Chemicals Ind. Corp.) CR-10 and CR-20.

These ion exchange resins are commercially available in the market and various kinds, and those meeting specific purposes can readily be obtained. Certain resins, which are not commercially available in the market, can be synthesized according to the method described in "Chelating Resin—Ion Exchange Resin" written by Y. Hojo. These can be used as solid adsorbing agents.

Porous resins useful in the present invention include organic synthetic resins having macropores with an average pore diameter of 500 nm or less.

Porous organic synthetic resins having no ion exchange groups include organic synthetic resins:

1) having macropores with an average pore diameter of 500 nm or less, and 2) not having any functional group to be dissociated itself to a positive or negative ion, such as, a quaternary amine group, a carboxyl group, and a sulfone group. To be concrete, examples thereof are a styrene-divinylbenzene copolymer, a chloromethylstyrene-divinylbenzene copolymer, a methoxymethylol-divinylbenzene copolymer, an ethylene-divinylbenzene copolymer, a methyl methacrylate-divinylbenzene copolymer, and a methyl acrylate-divinylbenzene copolymer.

Concrete structures thereof are shown below:

1.

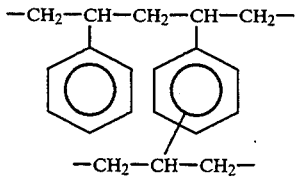

2.

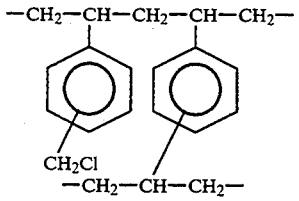

3.

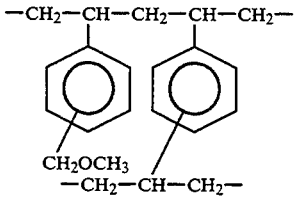

4.

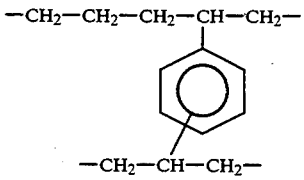

5.

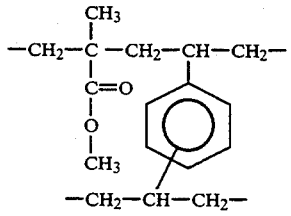

6.

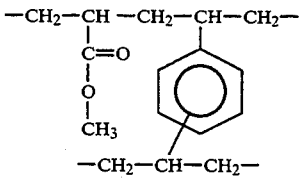

Linear polymer addition methods, and precipitant addition methods are known as synthetic methods for producing the porous resins, as described in the second chapter (page 127 seq.) of "Chelating Resin—Ion Exchange Resin" written by Y. Hojo, but such porous resins may be synthesized by any available, known method. A part of the above porous resins is commercially available in the market and can readily be obtained according to the intended purposes. Commercially available resins are shown in the following tables:

| Trade Name | Structural Resin | Specific Surface Area ($m^2$/g-HP) | Pore Volume (ml/g-HP) | Radius (Å) |
|---|---|---|---|---|
| HP 10* | Styrene | 500 | 0.9 | 100 to 700 |
| HP 20 | Styrene | 720 | 1.1 | 100 to 1300 |
| HP 30 | Styrene | 570 | 1.0 | 100 to 900 |
| HP 40 | Styrene | 700 | 0.7 | 100 to 600 |
| HP 50 | Styrene | 600 | 0.9 | 900 |

*manufactured by Mitsubishi Chemicals Ind. Corp.

| Trade Name* | Grain Size (μm) | Specific Surface Area ($m^2$/g) | Pore Volume (ml/g) |
|---|---|---|---|
| MCI GEL CHP20P | 37 to 75 | 500 to 700 | >1 |
| MCI GEL CHP20P | 75 to 150 | 500 to 700 | >1 |
| MCI GEL CHP20P | 150 to 300 | 500 to 700 | >1 |

*manufactured by Mitsubishi Chemicals Ind. Corp.

| Trade Name | Structural Resin | Specific Surface Area ($m^2$/g-HP) | Pore Volume (ml/g-HP) | Radius (Å) |
|---|---|---|---|---|
| XAD 1* | Styrene | 100 | — | 205 |
| XAD 2 | Styrene | 300 | 0.6 | 90 |
| XAD 4 | Styrene | 784 | 1.1 | 50 |
| XAD 7 | Styrene | 450 | 0.8 | 90 |
| XAD 8 | Styrene | 140 | 0.5 | 235 |
| XAD 9 | Sulfoxide | 69 | — | 366 |
| XAD 11 | Amide | 69 | — | 352 |
| XAD 12 | N-O polar group | 22 | — | 1300 |

*manufactured by Rohm & Haas Co., Ltd.

To be concrete, examples of the inorganic adsorbing carrier useful in the present invention include zeolite, diatomaceous earth, $MgO.nH_2O$, $MgO.xAl_2O_3.nH_2O$ (x=0 to 0.25) ( inorganic series adsorbing agent M-511 manufactured by Kunimine Ind. Co., Ltd. ), smectite, and montmorillonite.

These materials are commercially available as zeolite, synthetic zeolite A-3, synthetic zeolite A-4, and synthetic zeolite F-9, each manufactured by Wako Junyaku Ind. Co., Ltd. but the invention is not limited to the use of these specific materials; all zeolites described, for example, in "Zeolite—Base and Application", edited by N. Hara and H. Takahashi (Kohdansha, 1975), can be used.

The commercial materials Smectone and Kunipia (manufactured by Kunimine Ind. Co., Ltd.) are illustrative of materials that can be used as smectite and montmorillonite in this invention.

Of the solid adsorbing agents enumerated above, the preferred ones are active carbons, ion exchange resins, porous resins, and organic synthetic resins having no ion exchange group; the particularly preferred ones are active carbons, porous resins, and organic synthetic resins having no ion exchange group. The most preferred materials are organic synthetic resins having no ion exchange group.

The solid adsorbing agents enumerated above are available in various forms, such as, grains, powder, and membranes. The solid absorbing agents available in grain, powder, and/or membrane forms are preferred.

The size of the solid adsorbing agent is preferably larger than that of the silver halide grains contained in the silver halide emulsion. In many cases, these solid adsorbing agents remain in the silver halide emulsion, after the emulsion is processed with such agents, but the continued presence thereof sometimes exerts no adverse influence; generally, however, the solid adsorbing agents are preferably removed from the emulsion by filtering.

In the present invention, the removal of the silver halide solvent from a silver halide emulsion by use of a solid adsorbing agent, according to the present invention, generally calls for a step in which the solid adsorbing agent is added to the silver halide emulsion in a batch system, is stirred to mix, and the solid adsorbing agent is then filtered off to remove it, or for a step in which the silver halide emulsion is continuously passed through an adsorbing bed, or adsorbing cylinder, charged with solid adsorbing agent. Either step can be used in the present invention.

The amount of solid adsorbing agent which can be used is selected according to i) the performance of the adsorbing agent (for example, ion exchange capacity, whole adsorbing capacity, and pore capacity), ii) the form (grain size, and effective surface area), iii) content of subject silver halide emulsion (for example, the kind of organic silver halide solvent). For example, in the case of a batch system, the solid absorbing agent can be used in an amount falling within the range of 0.1 g to 1000 g per kg of the silver halide emulsion; in the case of a continuous system, assuming the amount of the solid adsorbing agent toward the total amount of the silver halide emulsion passing through, the solid absorbing agent can be used in the same range as is used in the batch system.

The processing temperature may reside in the range from a temperature at which the silver halide emulsion is liquefied (about 30° C.) to a temperature which the carrier can tolerate. The processing time may suitably be set at one minute or more in either a batch system, or in a continuous system.

The present invention is applied to an internal latent image type direct positive silver halide emulsion.

The internal latent image type direct positive silver halide emulsion (hereinafter referred to as an internal latent image type silver halide emulsion) means a silver halide emulsion in which a latent image is formed primarily in the inside of a silver halide grain, when it is subjected to an imagewise exposure. To be concrete, it is defined by such a factor that when the silver halide emulsion is coated on a transparent support in a fixed amount, the maximum density obtained by subjecting it to an exposure at the fixed time of 0.01 to 1 second and then to a development in the following developing solution A (the internal type developing solution) at 20° C. for five minutes, is at least five times as large as the maximum density obtained by developing the second sample exposed in the same manner, as above, in the following developing solution B (the surface type developing solution) at 20° C. for five minutes, wherein the maximum density is measured by a conventional photographic density measuring method:

| Developing Solution A | |
|---|---|
| N-methyl-p-aminophenol sulfite | 2 g |
| Sodium sulfite (anhydrous) | 90 g |
| Hydroquinone | 8 g |
| Sodium carbonate (monohydrate) | 52.5 g |
| Potassium bromide | 5 g |
| Potassium iodide | 0.5 g |
| Water was added to | 1 liter |
| **Developing Solution B** | |
| N-methylol-p-aminophenol sulfite | 2.5 g |
| 1-Ascorbic acid | 10 g |
| Potassium metanitrate | 35 g |
| Potassium bromide | 1 g |
| Water was added to | 1 liter |

There may be mentioned as internal latent image type silver halide emulsions, the conversion type silver halide emulsions, for example, as described in U.S. Pat. Nos. 2,456,953, and 2,592,250, laminated structure type silver halide emulsions in which silver halide compositions in the first layer, and the second layer are different, as described in U.S. Pat. No. 3,935,014, and core/shell type silver halide emulsions in which a metal ion is doped, or a shell is provided, on a core which is subjected to chemical sensitization. Of the foregoing, the core/shell type silver halide emulsion is preferred for use as the internal latent image type silver halide emulsion used in the present invention. As examples thereof, there may be mentioned the emulsions described in U.S. Pat. Nos. 3,206,313, 3,317,322, 3,761,266, 3,761,276, 3,850,637, 3,923,513, 4,035,185, 4,184,878, 4,395,478, and 4,504,570, and JP-A-57-136641, JP-A-61-3137, JP-A-61-299155, and JP-A-62-208241.

A direct positive image can be obtained by subjecting the above internal latent image type silver halide emulsion to an imagewise exposure, and then subjecting the whole surface of the exposed layer to a uniform, second exposure, before or in the course of development processing ("an optical fogging method" described in, for example, British Patent 1,151,363), or by carrying out the development processing in the presence of a nucleus forming agent ("a chemical fogging method", for example, as described in *Research Disclosure,* vol. 151, No. 15162, pp. 76 to 78). In the present invention, the preferred method in one in which the direct positive image is obtained by a "chemical fogging method". The nucleus forming agent used in the present invention will be described later.

As described above, the direct positive image can be obtained by subjecting an internal latent image type silver halide emulsion to an imagewise exposure, and then to an overall, and uniform, second exposure, before or in the course of development processing, or by carrying out the development processing in the presence of a nucleus forming agent. Illustrative of nucleus forming agents, which may be used in the invention are the hydrazines described in U.S. Pat. Nos. 2,563,785, and 2,588,982, the hydrazides and hydrazones described in U.S. Pat. No. 3,227,552, the heterocyclic quaternary salt compounds described in British Patent 1,283,835, JP-A-52-69613, JP-A-55-138742, JP-A-60-11837, JP-A-62-210451, and JP-A-62-291637, and U.S. Pat. Nos. 3,615,515, 3,719,494, 3,734,738, 4,094,683, 4,115,122, 4,306,016, and 4,471,044, the sensitizing dyes having a substituent with a nucleus forming function in the dye molecule, as described in U.S. Pat. No. 3,718,470, the thiourea bonding type acylhydrazine series compounds described in U.S. Pat. Nos. 4,030,925, 4,031,127, 4,245,037, 4,255,511, 4,266,013, and 4,276,364, and British Patent 2,012,443, and the acylhydrazine series compounds to which a thioamide ring and a heterocyclic group, such as, triazole and tetrazole, are bonded as an adsorbing group, as described in U.S. Pat. Nos. 4,080,270, and 4,278,748, and British Patent 2,011,391B.

The nucleus forming agent useful in this invention is preferably employed in an amount such that a sufficient maximum density is achieved when the internal latent image type emulsion is developed in a surface developing solution. Actually, the amount used will differ according to the characteristics of the silver halide emulsion used, the chemical structure of the nucleus forming agent, and the developing conditions, and, therefore, the suitable content of the nucleus forming agent can be varied over a wide range. It is actually useful in the range of from 0.1 mg to 5 g, and preferably from about 0.5 mg to 2 g per mole of silver contained in the internal latent image type silver halide emulsion. Where the nucleus forming agent is incorporated into a hydrophilic colloid layer adjacent to an emulsion layer, the same amount as above may be added, based on the amount of silver contained in the internal latent image type emulsion in the same area.

Silver halide grains of various forms can be used in the present invention. Examples thereof include grains having regular crystalline forms, such as, cubic, octahedral, tetradecahedral, and rhombic dodecahedral, grains having irregular crystalline forms, such as, spherical and plate, grains having higher face (hkl), and mixtures of the grains of the foregoing crystal forms. The grains having higher face can be identified by reference to the Journal of Imaging Science, vol. 30 (1986), pp. 247 to 254.

Silver halide grains useful in the present invention can be selected from regular crystals containing no twinned face, and examples described at p. 163 of Ground in a Photographic Industry, Chapter "Silver Salt Photography" (Corona Co.), for example, a singlet twinned crystal containing one twinned face, a parallel multiplet twinned crystal containing two or more parallel twinned faces, and a non-parallel multiplet twinned crystal containing two or more non-parallel twinned faces, according to the intended purpose.

Further, an example in which grains having different forms may be mixed is disclosed in U.S. Pat. No. 4,865,964, and this method may be selected for use as may be necessary.

In the case of using regular crystals, there can be used a cubic crystal consisting of a (100) face, an octahedral crystal consisting of a (111) face, and a dodecahedral crystal consisting of a (110) face, as disclosed in JP-B-55-427373, and JP-A-60-222842. Further, though the methods of preparing the following crystals have to be contrived, there can be selected and used according to the purposes, the (hll) face grains represented by a (211) face, the (hhl) face grains represented by a (331) face, the (hko) face grains represented by a (210) face, and the (hkl) face grains represented by a (321) face, as reported in Journal of Imaging Science, vol. 30, p. 247 (1986).

There can be selected and used according to the intended purposes, grains in which two faces, or a large number of faces coexist, such as, tetradecahedral grains in which a (110) face and a (111) face coexist in one grain, grains in which a (100) face and a (110) face coexist, or grains in which a (111) face, and a (110) face coexist.

As a silver halide composition for these grains, there may be used any silver halide selected from silver bromide, silver bromoiodide, silver bromochloroiodide, silver bromochloride, silver chloroiodide, and silver chloride. Of the foregoing, silver bromide and sliver bromoiodide are preferred. Further, in addition to the above silver salts, there may be included other grains or parts of silver halide grains, other silver salts, for example, silver thiocyanate, silver cyanate, silver sulfide, silver selenide, silver carbonate, silver phosphate, and silver organic acids.

The silver halide grains may have different phases in the inside and surface layer, or may consist of a uniform phase. The silver halide composition of the grains may be the same or different in the inside and in the surface layer, or may be of a layered structure, as described in JP-A-57-154232, JP-A-58-108533, JP-A-58-248469, JP-A-59-48755, and JP-A-59-52237, U.S. Pat. Nos. 3,505,068, 4,433,048, and 4,444,877, European Patent 100,984, and British Patent 1,027,146. Further, grains having a dislocation line may be used as well.

In the case of silver halide grains in which two or more silver halides are present as a mixed crystal, or with a structure, it is important to control the halide composition distribution between the grains. The method for measuring the halide composition distribution between the grains is described in JP-A-60-254032. A uniform halogen distribution between the grains is a desirable characteristic. In particular, a highly uniform emulsion having the fluctuation coefficient of 20% or less is preferred. Another preferred embodiment is an emulsion in which there is a desired correlation between grain size and silver halide composition.

It is important to control a halogen composition in the vicinity of grain surface. The increase in the silver iodide content, or silver chloride content in the vicinity of the surface leads to a change in the adsorbability of dye, and developing speed; therefore, the halogen composition can be selected according to the intended purposes. Where the halogen composition in the vicinity of the surface is changed, either a structure in which a whole grain is covered, or a structure in which only a part of the grain is covered, can be selected. In some cases, for example, only one face of the tetradecahedral grain consisting of a (100) face and a (111) face is changed as to its halogen composition, or one of the side faces or the primary plane in the tabular grain may be changed as to its halogen composition.

The grain size of the emulsion used in the present invention can be evaluated by a circle-corresponding diameter of a projected area observed with an electron microscope, by a sphere-corresponding diameter of a grain volume calculated from a projected area, and grain thickness, or by a sphere-corresponding diameter of volume measured by the coulter counter method. Useful grains can be selected from super fine grains of 0.05 $\mu$m or less to coarse grains exceeding 10 $\mu$m in terms of the sphere-corresponding diameter. Preferred is a grain of from about 0.1 $\mu$m to about 3 $\mu$m.

The grain size distribution of the silver halide grains is not critical, and may be selected from monodispersions, wherein the monodispersion is defined by a dispersion system in which 95% of the grains, based on the whole weight or whole number of the silver halide grains contained therein, falls within $\pm$60% or less, preferably $\pm$40% or less of the number average grain size; the number average grain size is the number average diameter of the circles corresponding to the projected areas of the silver halide grains.

Suitable monodisperse emulsions are described in U.S. Pat. Nos. 3,574,628, and 3,655,394, and British Patent 1,413,748, and these monodisperse emulsions may be used in admixture.

It is possible to use in combination two or more kinds of these silver halides having different crystal habits, halogen composition, grain sizes, and grain size distributions, and to use them for the different emulsion layers and/or the same layer, respectively.

In the present invention, the use of tabular silver halide grains can provide further preferable effects. The manufacturing methods and application techniques of the tabular silver halide grains are described at page 131 of Photography Theory and Practice written by Cleve (1930); Photographic Science and Engineering written by Gutoff, vol. 14, pp. 248 to 257 (1970); U.S. Pat. Nos. 4,434,226, 4,414,310, 4,433,048, 4,439,520, 4,414,306, and 4,459,353, British Patent 2,112,157, and JP-A-59-99433 and JP-A-62-209445. In particular, tabular internal latent image type direct positive silver halide emulsions are described in detail in U.S. Pat. Nos. 4,395,478, 4,504,570, and 4,996,137, JP-B-64-8327, and JP-A-1-131547. These tabular internal latent image type direct positive silver halide emulsions are excellent in terms of providing a direct positive image having good sharpness, rapid developing speed, and low temperature dependency.

The form of the tabular grains can be selected from triangular, hexagonal, and circular. A regular hexagonal having six sides of almost equal lengths described in U.S. Pat. No. 4,996,137 is the preferred form.

In the case of tabular grains, dislocation lines can be observed with a transmission type electron microscope. Grains containing no dislocation lines at all, grains containing several dislocation lines, or grains containing numerous dislocation lines can be selected according to the intended purpose. Further, a dislocation line introduced linearly to a specific direction in the crystal orientation of the grain, or a curved dislocation line can also be selected. Tabular grains can also be selected from those having dislocation lines introduced over the whole grain, or dislocation lines introduced only into the specific part of the grain, for example, dislocation lines introduced which are limited only to fringe sites of the grain. The dislocation lines can be introduced not only into the tabular grains, but also into regular crystal grains, or into irregular grains represented by pebble-like grains.

The tabular silver halide grains into which the dislocation is intentionally introduced are, for example, disclosed in JP-A-63-220238, and JP-A-1-201649.

The preferred ratio of average grain diameter to average grain thickness (hereinafter referred to as grain diameter/thickness) in the tabular grains is 2 or more, preferably 3 to 12, and particularly preferably 5 to 8, wherein the average grain diameter in the tabular silver halide grains is represented by the average value of the circle-corresponding diameters of two opposite parallel, or almost parallel, primary planes (the diameters of the circles having the same area as the projected area of the primary planes), and the average grain thickness is represented by the average value of the distances between the primary planes.

The grain diameter/thickness can be obtained by averaging the grain diameter/thickness of all of the grains. It can also be obtained in a simple manner in terms of the ratio of an average diameter to an average thickness of all of the grains.

The average grain diameter (circle-corresponding) of the tabular grains is 0.3 μm or more, preferably 0.3 to 10 μm, more preferably 0.5 to 5.0 μm, and further more preferably 0.5 to 3.0 μm.

The grain thickness is less than 1.0 μm, and, preferably, 0.05 to 0.5 μm.

An emulsion of highly uniform thickness having a fluctuation coefficient of 30% or less in grain thickness is preferred as well. Further preferred are grains in which the grain thickness and the distance between the twinned planes are regulated, as is described in JP-A-63-163451.

In the present invention, the above tabular grains share 50% or more, preferably 70% or more, and more preferably, 90% or more based on the total of grains in the emulsion containing them.

The grain diameter and grain thickness of the grains can be measured with electron microscope photographs of the grains, according to the method described in U.S. Pat. No. 4,434,226.

Further, in the present invention, the tabular grains are preferably monodisperse. The structure and method of preparation of the monodisperse tabular grains are described, for example, in JP-A-63-151618.

Silver halide emulsions used in the present invention may be treated to provide the grains with roundness, as disclosed in European Patents 96,727B1 and 64,412B1, or to provide surface modification, as disclosed in German Patent 2,306,447C2, and JP-A-60-221320.

In general, the grains have surfaces of a flat constitution, but it is preferred, in some cases, that roughness be intentionally imparted to the surfaces. Examples of such methods include processes in which a hole is made at a part of crystal, for example, in a peak or at the center of a plane, as is described in JP-A-58-106532, and JP-A-60-221320, and the ruffle grains, as are described in U.S. Pat. No. 4,643,966.

The silver halide grains used in the present invention can be prepared by using the methods described in *Research Disclosure* (RD) No. 17643 (December 1978), pp. 22 to 23, "I Emulsion preparation and types", RD No. 18716 (November 1979), p. 648, and RD No. 307105 (November 1989), pp. 863 to 865; Chimie et Physique Photographique written by P. Glafkides, published by Paul Montel Co., Ltd. (1967); Photographic Emulsion Chemistry written by G. F. Duffin, published by The Focal Press Co., Ltd. (1966); and Making and Coating Photographic Emulsion written by V. L. Zelikman et al, published by The Focal Press Co., Ltd. (1964). That is, any method, such as an acid method, a neutral method, and an ammonia method may used; there may also be used as the procedure for reacting a soluble silver salt with a soluble halide, any method, such as, a single jet method, a double jet method, and combinations thereof. There can also be used the method of forming the silver halide grains in the presence of an excess of silver ion (a so-called reverse mixing method). There can also be used as one form of the double jet method, the method in which the pAg of a solution, in which silver halide is prepared, is maintained at a fixed level, that is, a controlled double jet method. The silver halide emulsion consisting of the silver halide grains, with a regular crystal form, and an almost uniform grain size can be obtained with this method.

The tabular grains can readily be prepared according to the methods described in Photographic Science and Engineering written by Gutoff, vol. 14, pp. 248 to 257 (1970); U.S. Pat. Nos. 4,434,226, 4,414,310, 4,433,048, and 4,439,520, and British Patent 2,112,157.

The silver halide emulsion consisting of the above regular grains can be obtained by controlling pAg and pH during grain formation. The details are described, for example, in Photographic Science and Engineering, vol. 6, pp. 159 to 165 (1962); Journal of Photographic Science, vol. 12, pp. 242 to 251 (1964), U.S. Pat. No. 3,655,394, and British Patent 1,413,748.

The monodisperse emulsions are described in JP-A-48-8600, JP-A-51-39027, JP-A-51-83097, JP-A-53-137133, JP-A-54-48521, JP-A-54-99419, JP-A-58-37635, and JP-A-58-49938, JP-B-47-11386, U.S. Pat. No. 3,655,394, and British Patent 1,413,748.

In some cases the preferred method is one in which the silver halide grains are precipitated and formed before being added into the reaction vessel for preparing the emulsion, as is described in U.S. Pat. Nos. 4,334,012, 4,301,241, and 4,150994. These can be used as seed crystals, and effectively added as silver halide for growth. In the latter case, an emulsion having a smaller grain size is preferably added. The method of adding the grains can be selected from methods in which the entire amount is added in one batch, it is added divided into several portions, or it is continuously added. Further, grains having various halogen compositions are effectively added, in some cases, in order to modify the surfaces thereof.

The method in which a greater or lesser part of a halogen composition in silver halide grains is converted by a halogen conversion method is described in U.S. Pat. Nos. 3,477,852, and 4,142,900, European Patents 273,429, and 273,430, and West German Patent Application (OLS) No. 3,819,241, and it is an effective method for preparing the grains. A soluble halide solution or silver halide grains can be added in order to convert the grains to even less soluble, i.e., scarcely soluble silver salts. The foregoing conversion method can be selected from methods in which the conversion carried out at one time, the conversion is carried out incrementally, or the conversion is continuously carried out.

In addition to the method in which the grains are grown by adding a soluble silver salt and halide at a fixed concentration and a fixed flowing speed, it is preferred to use a grain formation method in which the concentration is changed, or flow speed is changed, as described in British Patent 1,469,480, and U.S. Pat. Nos. 3,650,757, and 4,242,455. The concentration or flow speed can be increased to change the amount of silver halide supplied according to a linear function, a quadric function, or a more complex function as to the time of addition. The amount of silver halide supplied is preferably decreased, in some cases, according to necessity. Further, where plural soluble silver salts, having different solution compositions are added, or plural soluble halides, having the different solution compositions, are added, the method of addition in which one is increased, and the other is decreased, is also an effective method.

The mixing vessel for reacting solutions of soluble silver salts and soluble halides can be selected from the methods described in U.S. Pat. Nos. 2,996,287, 3,342,605, 3,415,650, and 3,785,777, and West German Patent Application (OLS) Nos. 2,556,885, and 2,555,364.

In preparing an emulsion containing tabular grains, the preferred method is one in which the addition speeds, addition amounts, and addition concentrations of silver salt solution (for example, a silver nitrate aqueous solution), and a halide solution (for example, KBr solution), are increased in order to accelerate grain growth. These methods are described, for example, in British Patent 1,335,925, U.S. Pat. Nos. 3,672,900, 3,650,757, and 4,242,445, and JP-A-55-142329 and JP-A-55-158124.

In preparing emulsions for use in the present invention, for example, in forming the grains, during a desalting step, during a chemical sensitization, or before coating, salts of metal ions are preferably allowed to be present according to the end purposes of the emulsion. Such doping of metal ions can increase excessive exposure, which does not lead to reinversion, and to a decrease in minimum density. The ions are added, preferably, during the formation of the grains when they are doped into the grains, and after formation of the grains, to prior to the completion of chemical sensitization, at which time the ions are used as modifiers or chemical sensitizers for the grain surfaces. There can be selected as well methods in which the ions are doped into the entire grain, only in a core portion, only in a shell portion, only in an epitaxial portion, or only in a base grain. The ions which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. The ions can be added as long as they are in a salt form which can be dissolved in preparing the grains; such salts include ammonium, acetate, nitrate, sulfate, phosphate, hydroxide, hexaligand complex, and tetraligand complex salts. Examples of such salts include $CdBr_2$, $CdCl_2$, $Cd(NO_3)_2$, $Pb(NO_3)_2$, $Pd(CH_3COO)_2$, $K_3[Fe(CN)_6]$, $(NH_4)_4[Fe(CN)_6]$, $K_3IrCl_6$, $NH_4RhCl_6$, and $K_4Ru(CN)_6$. The ligand for a coordinate compound can be selected from halo, aquo, cyano, cyanate, thiocyanate, nitrosyl, thionitrosyl, oxo, and carbonyl. A single kind of metal compound salts may be used alone, or two or more kinds thereof may be used in combination.

The metal compounds are preferably dissolved in water or a suitable solvent, such as, methanol and acetone, to facilitate addition of the compounds. Addition methods may be used in which a hydrogen halide aqueous solution (for example, HCl and HBr), or an alkali halide aqueous solution (for example, KCl, NaCl, KBr, and NaBr) are used in order to stabilize a solution. Further, acid and alkali may be added as needed. The metal compounds can be added to a reaction vessel either before forming the grains, or during grain formation. They can also be added to a water soluble silver salt (for example, silver nitrate), or an alkali halide aqueous solution (for example, NaCl, KBr and KI) for continuous addition during formation of the silver halide grains. Further, a solution, independent from the water soluble silver salt and alkali halide, may be prepared for continuous addition at a suitable period during grain formation. Various methods of addition are preferably combined.

The method in which chalcogenide compounds, described in U.S. Pat. No. 3,772,031, are used in preparing an emulsion is effective in some cases. In addition to S, Se and Te, there may be allowed to be present cyanates, thiocyanates, selenocyanates, carbonates, phosphates, and acetates. These are described in U.S. Pat. Nos. 2,448,060, 2,628,167, 3,737,313, and 3,772,031, and *Research Disclosure,* vol. 134, 13452 (June 1975).

As described above, the internal latent image type silver halide grains for use in the present invention have preferably a core/shell structure. For the method for forming a shell one can refer to the examples of JP-A-63-151618, and U.S. Pat. Nos. 3,206,316, 3,317,322, 3,761,276, 4,269,927, and 3,367,778. In such a case, the mole ratio (weight mole ratio) of core/shell is preferably 1/30 to 5/1, more preferably 1/20 to 2/1, and further more preferably 1/20 to 1/1.

In the silver halide emulsions of the present invention, after a core grain has been subjected to chemical sensitization and covered with a shell, the surface of the grain is further subjected preferably to chemical sensitization, but the grain surface may not be subjected to the chemical sensitization. In general, grains, the surfaces of which are subjected to chemical sensitization, reveal excellent inversion performance, with a high maximum density. Where grain surfaces are subjected to the chemical sensitization, the polymer described in JP-A-57-13641 may be present.

The above chemical sensitization can be carried out with active gelatin as described at pages 67 to 76 of "The Theory of the Photographic Process", written by T. H. James, 4th ed., edited by MacMillan Co., 1977. Further, as described in *Research Disclosure* vol. 120 (April 1974), 12008, *Research Disclosure* vol. 34 (June 1975), 13452, U.S. Pat. Nos. 2,642,361, 3,297,446, 3,772,031, 3,857,711, 3,901,714, 4,266,018, and 3,904,415, and British Patent 1,315,755, the chemical sensitization can be carried out with sulfur, selenium, tellurium, gold, platinum, palladium, iridium, rhodium, osmium, rhenium, or combinations of a plurality of these sensitizers at a pAg of 5 to 10, pH of 4 to 8, and a temperature of 30° to 80° C.

Chemical sensitization Can be carried out as well in the presence of a chemical sensitization aid. As chemical sensitization aids, compounds may be used which are known for their ability to control fog, and increase sensitivity in the course of chemical sensitization, such as, azaindene, azapyridadine, and azapyrimidine. Examples of chemical sensitization aids are described in U.S. Pat. Nos. 2,131,038, 3,411,914, and 3,554,757, JP-A-58-126526, and JP-A-62-253159, and "Photographic Emulsion & Chemistry" written by Duffin, pp. 138 to 143 (published by The Focal Press Co., 1966).

Silver halide emulsions useful in the invention can be subjected to reduction sensitization in the inside of the grains during precipitation/formation, as described in JP-B-58-1410, and Journal of Photographic Science, Moisar et al, vol. 25, pp. 19 to 27, 1977.

The following reduction sensitization procedures can be applied to effect chemical sensitization:

i) reduction sensitization can be carried out, for example, with hydrogen, as described in U.S. Pat. Nos. 3,891,446 and 3,984,249;

ii) further, reduction sensitization can be carried out with a reducing agent or by processing at low pAg (for example, a pAg of less than 5), or at high pH (for example, a pH greater than 8) as described in U.S. Pat. Nos. 2,518,698, 2,743,182 and 2,743,183.

Publicly known, representative reduction sensitizers are stannous salts, ascorbic acid, and derivatives thereof, amines and polyamines, hydrazine derivatives, formamidinesulfinic acid, a silane compound, and a borane compound. These reduction sensitizers can be selected and used for reduction sensitization in the present invention. Two or more kinds of the foregoing compounds can also be used in combination. Preferred as the reduction sensitizers are stannous chloride, thiourea dioxide, dimethylamine borane, and ascorbic acid, and derivatives thereof.

Further, the chemical sensitization methods described in U.S. Pat. Nos. 3,917,485 and 3,966,476 can be applied as well.

There can also be applied sensitizing methods in which an "oxidizing agent" is used, as described in JP-A-61-3134, and JP-A-61-3136.

A compound which is an oxidizing agent to silver is a compound having the function of acting on metallic silver to convert it to silver ions. Particularly effective are compounds which convert to silver ions the very fine silver grains which are by-produced in the course of the formation and chemical sensitization of silver halide grains. The silver ion formed may be in the form of a silver salt which is scarcely soluble in water, such as silver halide, sliver sulfide, and silver selenide, and may form a silver salt which is readily soluble in water, such as, silver nitrate. The compounds acting as an oxidizing agent for silver may be either an inorganic compound or an organic compound. As examples of inorganic oxidizing agents, there may be mentioned ozone, hydrogen peroxide, and adducts thereof (for example, $NaBO_2.H_2O_2.3H_2O.2NaCO_3.3H_2O_2$, $Na_4P_2O_7.2H_2O_2$, and $2Na_2SO_4.H_2O_2.2H_2O$), oxygen acid salts, such as, peroxy acid salts (for example, $K_2S_2O_8$, $K_2C_2O_6$, and $K_2P_2O_8$), peroxy complex compounds (for example, $K_2[Ti(O_2)C_2O_4].3H_2O$, and $4K_2SO_4.Ti(O_2)OH.SO_4.2H_2O$), permanganate (for example, $KMnO_4$), and chromates (for example, $K_2Cr_2O_7$), a halogen element, such as, iodine, or bromine, perhalogen acid salts (for example, potassium periodate), high valence metal salts (for example, potassium hexacyanoferrate (III)), and thiosulfonates.

Further, examples of organic oxidizing agents include quinones, such as, p-quinone, organic peroxides, such as, peracetic acid, and perbenzoic acid, and compounds releasing an active halogen (for example, N-bromosuccinimide, chloramine T, and chloramine B).

The preferred oxidizing agents, according to the present invention, are ozone, hydrogen peroxide, and adducts thereof, a halogen element, inorganic oxidizing agents of thiosulfonate, and organic oxidizing agents of quinones. The combined use of the above reduction sensitizer and oxidizing agent to silver is a preferred embodiment. Methods, therefore, can be used which include methods in which the oxidizing agent is used, and then the reduction sensitization is carried out, or the contrary methods, or methods in which both procedures are carried out at the same time. These methods can be selected and used either at the grain formation step, or at the chemical sensitization step.

Gelatin is advantageously used as a protective colloid in preparing the emulsions of the present invention, but the other hydrophilic colloids can be used as well.

As a protective colloid, there can be used, for example, protein, such as, gelatin derivatives, graft polymers of gelatin, and other polymers, albumin, and casein; cellulose derivatives, such as, hydroxyethyl cellulose, carboxymethyl cellulose, and cellulose sulfuric acid esters; sugar derivatives, such as, sodium alginate and starch derivatives; various synthetic hydrophilic high molecular substances, such as, homopolymers, and copolymers of polyvinyl alcohol, partially acetalized polyvinyl alcohol, poly-N-vinyl pyrrolidone, polyacrylic acid, polymethacrylic acid, polyacrylamide, polyvinyl imidazole, and polyvinyl pyrazole.

Gelatins that may be used include acid-processed gelatin, and enzyme-processed gelatin described in Bull. Soc. Sci. Photo. Japan, No. 16, P 30 (1966), as well as lime-processed gelatin. Further, hydrolysis products and enzyme decomposition products of gelatin can be used as well. A lot of impurity ions are contained in gelatin, and therefore, gelatin which is subjected to treatment with an ion exchange resin to decrease the amount of inorganic ion impurities is preferably used as well.

Emulsions of the present invention are preferably washed with water for desilveration to disperse them in newly prepared protective colloids. The washing temperature can be selected according to need, and is selected preferably in the range of 5° to 50° C. The pH in the washing step can also be selected according to need, and is selected preferably in the range of 2 to 10, and, more preferably, 3 to 8. pAg in the washing step can also be selected according to the end purpose and is selected preferably in the range of 5 to 10. Examples of suitable washing methods include noodle washing, dialysis with a semi-permeable membrane, centrifuging, precipitation/settling, and ion exchange methods. In the case of using precipitation/settling the method can be selected from those in which sulfate is used, in which an organic solvent is used, in which a flocculation polymer is used, and in which gelatin derivatives are used.

In the present invention, spectral sensitization can be carried out with a sensitizing dye. There are available as useful sensitizing dyes, cyanine dyes, merocyanine dyes, complex cyanine dyes, complex merocyanine dyes, holopolarcyanine dyes, hemicyanine dyes, styryl dyes, and hemioxonol dyes. To be concrete, illustrative examples of sensitizing dyes are described in U.S. Pat. No. 4,617,257, JP-A-59-180550, JP-A-60-140335, and JP-A-61-160739, RD 17029 (1978) pp. 12 to 13, and RD 17643 (1978) p. 23.

These sensitizing dyes may be used singly or in combination. Combinations of sensitizing dyes are frequently used particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936 and JP-B-53-12375, and JP-A-52-110618, and JP-A-52-109925.

In addition to sensitizing dyes, there may be incorporated into the emulsions, dyes having no spectral sensitization action by themselves, or materials which do not substantially absorb visible rays, but show supersensitization (for example, the compounds described in U.S. Pat. Nos. 3,615,613, 3,615,641, 3,617,295, 3,635,721, 2,933,390, and 3,743,510, and JP-A-63-23145).

The timing for the addition of sensitizing dyes to an emulsion may be at any step in the preparation of the emulsion, where such addition is known to be effective. Most usually, the sensitizing dye is added during the period between the completion of chemical sensitization and coating. Sensitizing dyes can be added during the same time period in which the addition of chemical sensitizers, and spectral sensitization are carried out, at the same time as chemical sensitization is carried out, as is described in U.S. Pat. Nos. 3,628,969 and 4,225,666; it can also be added prior to the chemical sensitization, as described in JP-A-58-113928; or it can be added before the completion of settling of the silver halide grains to start the spectral sensitization. Furthermore, the above compounds can be divided and added, as taught in U.S. Pat. No. 4,225,666; that is, it is possible to add a part of these compounds prior to chemical sensitization, and to add the remainder after the completion of chemical sensitization. Also, the sensitizing dyes may be added at any stage in the formation of sliver halide grains, including the method disclosed in U.S. Pat. No. 4,183,756.

The amount of added sensitizing dyes is $10^{-8}$ to $10^{-2}$ mole per mole of silver halide; in the case of the use of the preferred silver halide grain size of 0.2 to 1.2 μm, about $5\times10^{-5}$ to $2\times10^{-3}$ mole per mole of silver halide is more effective.

The amount of coated light-sensitive silver halide used in the present invention is in the range of 1 mg to 10 g/m$^2$ in terms of the amount converted to silver.

In the present invention, various anti-fogging agents, and photographic stabilizers can be used for the purpose of preventing the reduction of sensitivity, and the generation of fog. As the examples thereof, there may be used the azoles, and azaindenes described in RD 17643 (1978), pp. 24 to 25, and U.S. Pat. No. 4,629,678, carboxylic acids containing nitrogen and phosphoric acids as are described in JP-A-59-168442, mercapto compounds, and the metal salts thereof, as are described in JP-A-59-111636, and acetylene compounds, as described in JP-A-62-87957.

These additives are described in *Research Disclosure*, Nos. 17643 (December 1978), 18716 (November 1979) and 30710 (November 1989) a summary of which is presented in Table A below.

TABLE A

| Kind of additive | RD17643 (Dec. '78) | RD18716 (Nov. '79) | RD307105 (Nov. '89) |
|---|---|---|---|
| 1. Chemical sensitizer | p. 23 | p. 648 right column (RC) | p. 866 |
| 2. Sensitivity improver | — | p. 648 right column (RC) | — |
| 3. Spectral sensitizer and supersensitizer | pp. 23–24 | p. 648 RC-p. 649 RC | pp. 866–868 |
| 4. Whitening agent | p. 24 | p. 647 | p. 868 |
| 5. Antifoggant and stabilizer | pp. 24–25 | p. 649 RC | pp. 868–870 |
| 6. Light absorbent, filter dye, and UV absorbent | pp. 25–26 | p. 649 RC-pp. 650 left column (LC) | p. 873 |
| 7. Anti-stain agent | p. 25 RC | p. 650 LC-RC | p. 872 |
| 8. Dye image stabilizer | p. 25 | p.650 LC | " |
| 9. Hardener | p. 26 | p. 651 LC | pp. 874–875 |
| 10. Binder | p. 26 | " | pp. 873–874 |
| 11. Plasticizer and lubricant | p. 27 | p. 650 RC | p. 876 |
| 12. Coating aid and surfactant | pp. 26–27 | " | pp. 875–876 |
| 13. Anti-static agent | p. 27 | " | pp. 876–877 |
| 14. Matting agent | — | — | pp. 878–879 |

The respective components included in the present invention will be explained below in the order in which they appear in a photographic film unit, as follow:

I. Light-Sensitive Sheet

A) Support

Any practical support material can be used as a support for the light-sensitive sheets of the present invention, as long as it is a transparent, flat support which is usually used for a photographic light-sensitive material. Examples of useful support materials include cellulose acetate, polystyrene, polyethylene terephthalate, and polycarbonate; a subbing layer is preferably provided. The support usually contains a trace amount of a dye or a pigment, such as, titanium oxide, in order to prevent a light piping.

The thickness of the support is 50 to 350 μm, preferably, 70 to 210 μm, and, more preferably, 80 to 150 μm.

A layer for adjusting curl balance, or an oxygen shielding layer, as described in JP-A-56-78833, can be provided on the back side of the support, should such layers be needed.

B) Image-receiving Layer

Dye image receiving layers useful in the present invention contain mordant agents in a hydrophilic colloid. This layer may be a single layer or may be of multilayer construction, in which mordant agents, each having a different mordant power, are arranged one above the other. This is described in JP-A-61-252551. A polymer mordant is preferred as the mordant.

The polymer mordant agent may be a polymer having a secondary or tertiary amino group, a polymer having a nitrogen-containing heterocyclic ring portion, or a polymer containing a quaternary cation. Polymers having a molecular weight of 5,000 or more are useful, and particularly preferable are polymers of a molecular weight of 10,000 or more.

The amount of the mordant agent coated on its layer is generally 0.5 to 10 g/m$^2$, preferably 1.0 to 5.0 g/m$^2$, and, particularly preferably, 2 to 4 g/m$^2$.

Used as hydrophilic colloids for the image-receiving layers are gelatin, polyvinyl alcohol, polyacrylamide, and polyvinyl pyrrolidone; gelatin is preferred.

The anti-fading agents described in JP-B-62-30620, JP-B-62-30621 and JP-A-62-215272 can be incorporated into the image receiving layer.

C) White Color Reflection Layer

A white color reflection layer constituting a white background of a dye image usually contains a white pigment and a hydrophilic binder.

Useful as the white pigment for the white color reflection layer are the following illustrative materials; barium sulfate, zinc oxide, barium stearate, silver flake, silicates, alumina, zirconium oxide, zirconium sodium sulfate, kaolin, mica, and titanium dioxide. Further, a non-layer forming polymer grain consisting of styrene may also be used. These materials may be used singly or as mixtures thereof, in a range in which a desired reflection rate can be obtained.

A particularly useful white pigment is titanium dioxide.

The degree of whiteness of the white color reflection layer is changed by kind of the pigment used, the mixing ratio of pigment and binder, and the amount of pigment coated on the layer; the light reflection rate is preferably 70% or more. In general, as the amount of pigment coated on the layer increases, the greater is the improvement in the degree of whiteness. However, when an image-forming dye is diffused through this layer, the pigment hinders the diffusion of the dye. Accordingly, taking the above conditions into consideration, a suitable coated amount is selected.

Titanium dioxide is coated in an amount of 5 to 40 g/m$^2$, and preferably 10 to 25 g/m$^2$; preferred is a white color reflection layer having a light reflection rate of 78 to 85%, at a wavelength of 540 nm.

The titanium dioxide which is used can be selected from various commercially available brands. Particularly preferred for use is a rutile type titanium dioxide.

Many of the commercially available products are subjected to surface treatment with alumina, silica and zinc oxide, and the surface treatment proportion is desirably 5% or more, in order to obtain a high degree of reflection. Examples of commercially available titanium dioxide include compounds described in *Research Disclosure* No. 15162, as well as Ti-pure R 931, manufactured by Du Pont Co., Ltd.

As a binder for the white reflection layer, there can be used an alkali penetrable high polymer matrix, for example, gelatin, polyvinyl alcohol, and cellulose derivatives, such as, hydroxyethyl cellulose and carboxymethyl cellulose.

The particularly preferred binder for the white color reflection layer is gelatin. The ratio of the white pigment to gelatin is 1/1 to 20/1 (ratio by weight), and more favorably is 5/1 to 10/1 (ratio by weight).

Anti-fading agents, as are described in JP-B-62-30620 and JP-B-62-30621, are preferably incorporated into the white color reflection layer.

D) Light Shielding Layer

A light shielding layer containing a light shielding agent and a hydrophilic binder is provided between the white color reflection layer and the light-sensitive layer.

Any of the materials having the function of light shielding can be used as the light shielding agent, and carbon black is preferably used. Further, there may be used degradable dyes, such as, those described in U.S. Pat. No. 4,615,966, and others.

Any binder can be used for coating the light shielding agent, as long as it can disperse carbon black; gelatin is preferred.

Useful as the raw material for carbon black are carbon blacks manufactured by any available method, such as, channel methods, thermal methods and furnace methods, each described, for example, in "Carbon Black" written by Donnel Voet, Marcel Dekker Inc. (1976). The grain size of carbon black is not specifically limited, and is preferably 90 to 1800 Å. The addition amount of black pigment as a light shielding agent may be adjusted according to the sensitivity of the light-sensitive material to be shielded, and it is preferably from about 5 to about 10 in terms of an optical density.

E) Light-Sensitive Layer

In the present invention, a light-sensitive layer consisting of a silver halide emulsion layer combined with a dye image-forming material is provided above the light shielding layer. The constituent elements of this layer will be described below.

(1) Dye Image-Forming Material

Dye image-forming materials used in the present invention are non-diffusible compounds which release diffusible dyes (which may be a dye precursors) in relation to silver development, or compounds in which the diffusibility of the compounds themselves changes in relation to silver development; such compounds are described in The Theory of Photographic Process, Fourth Edition. Any of these compounds can be represented by the following Formula (I):

$$\text{DYE—Y} \qquad \text{(I)}$$

wherein DYE represents a dye or the precursor thereof; Y represents a component which provides a compound, having a diffusibility different from that of the compound represented by formula (I), under alkaline conditions. Compounds represented by Formula (I) can be classified roughly into negative type compounds which provide a diffusible compound in a silver developing area according to the function of Y, and positive type compounds which provide a diffusible compound in a non-developing area, according to the function of Y.

Examples of negative type Y components include those which are oxidized, and split, as the result of development, to release a diffusible dye.

Concrete examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, and JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, and JP-A-57-119345.

In a negative type dye-releasing redox compound, there can be given as a particularly preferred Y group, an N-substituted sulfamoyl group (the N-substituent group includes a group which is derived from an aromatic hydrocarbon ring, and a heterocyclic ring). Representative examples of Y are shown below, but this invention is not limited thereto:

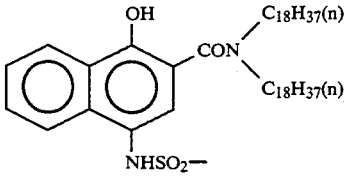

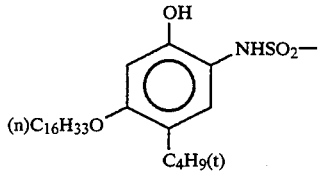

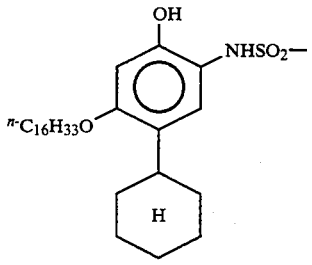

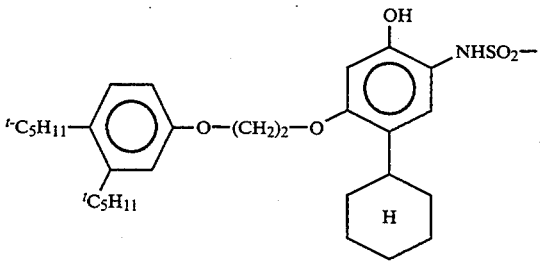

-continued

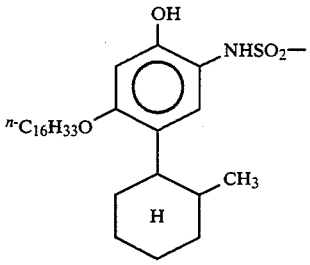

Positive type compounds are described in Angev. Chem. Inst. Ed. Engl. vol. 22, p. 191 (1982).

Examples thereof include compounds (dye developing agents) which are initially diffusible, under an alkaline conditions, but are oxidized by development to become non-diffusible. Those described in U.S. Pat. No. 2,983,606 are typical Y components which are effective for positive type compounds of this type.

Another useful type includes compounds which are subjected to self-ring closure, under alkaline conditions, to release a diffusible dye, but are oxidized by development to substantially stop releasing the dye. Concrete examples of Y groups having such a function are described in U.S. Pat. No. 3,980,479, JP-A-53-69033 and JP-A-54-130927, and U.S. Pat. Nos. 3,421,964 and 4,199,355.

Further, there is available as another type which includes compounds which do not release a dye by themselves, but release dyes upon reduction. Compounds of this type are used in combination with an electron donor, and can release imagewise a diffusible dye by reaction with the remainder of the electron donor, which is imagewise oxidized by silver development. Atomic groups having such a function are described, for example, in U.S. Pat. Nos. 4,183,753, 4,142,891, 4,278,750, 4,139,379, and 4,218,368, JP-A-53-110827, U.S. Pat. Nos. 4,278,750, 4,356,249, and 4,358,535, JP-A-53-110827, JP-A-54-130927, and JP-A-56-164342, Kokai Giho 87-6199, and EP-A-220746.

Concrete examples thereof are shown below, but this invention is not limited thereto:

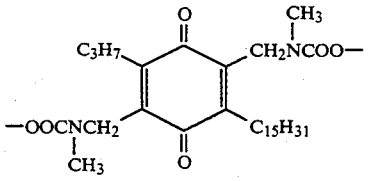

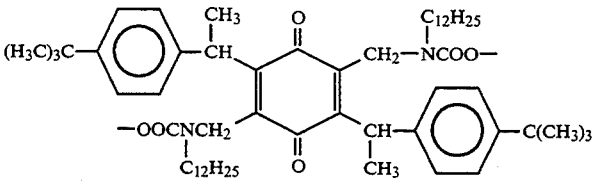

-continued

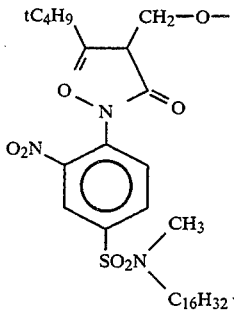

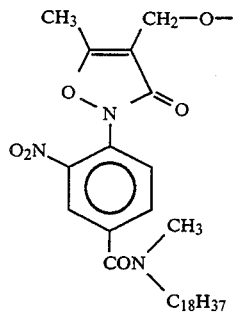

Where compounds of the foregoing type are used, it is used preferably in combination with a diffusion-resistant electron donor (known as an ED compound), or the precursor thereof. The examples of ED compounds are described in U.S. Pat. Nos. 4,263,393 and 4,278,750, and JP-A-56-138736.

The following compounds are concrete examples of dye image-forming materials of another type:

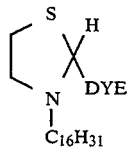

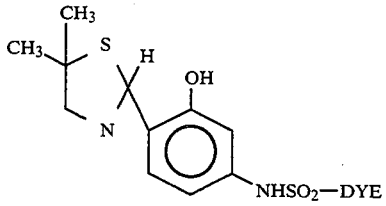

wherein DYE represents the same dye, or precursor thereof, as were described above.

The details thereof are described in U.S. Pat. Nos. 3,719,489 and 4,098,783.

Meanwhile, concrete examples of dyes represented by DYE in the foregoing formulas are described in the following publications:

a) Examples of Yellow Dyes

The compounds described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930 and JP-A-56-71072, *Research Disclosure* 17630 (1978) and RD 16475 (1977);

b) Examples of Magenta Dyes

The compounds described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and JP-A-52-106727, JP-A-52-106727, JP-A-53-23628, JP-A-55-36804, JP-A-56-73057, JP-A-56-71060, and JP-A-55-134;

c) Examples of Cyan Dyes

The compounds described in U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, and JP-A-56-71061, European Patents 53,037 and 53,040, *Research Disclosure* 17630 (1978) and RD 16475 (1977).

These compounds can be dispersed by the method described at pages 144 to 146 of JP-A-62-215272. Further, the compounds described at pages 137 to 144 of JP-A-62-215272 may be incorporated into these dispersions.

(2) Silver Halide Emulsion

The previously described emulsions are useful as the silver halide emulsion of the present invention.

(3) Constitution of the Light-Sensitive Layer

In order to reproduce a natural color by a subtractive color process, a light-sensitive layer is used which comprises the combination of at least two components of an emulsion spectrally sensitized by one of the above spectral sensitizing dyes, and the above dye image-forming materials which provide dyes having selective spectral absorption in the same wavelength range. The emulsions and dye image-forming materials may be provided each in a different layer, superposing one on another, or both may be mixed and applied in a single layer. Where the dye image-forming material has an absorption in the spectral sensitivity region of the emulsion combined therewith when it is coated, each is preferably provided in a different layer. Also, the emulsion layer may consist of plural emulsion layers, each having a different sensitivity, or an arbitrary layer may be provided between the emulsion layer, and dye image-forming material layer. There can be provided, for example, a layer containing a nucleus-forming development accelerator, described in JP-A-60-173541, and a partition wall layer described in JP-B-60-15267 to increase dye image density; a reflection layer can be provided as well to raise the sensitivity of the light-sensitive element.

The reflection layer is a layer containing a white pigment and a hydrophilic binder. The white pigment is preferably titanium oxide and the hydrophilic binder is preferably gelatin. The amount of coated titanium oxide is 0.1 to 8 g/m$^2$, and preferably, 0.2 to 4 g/m$^2$. Examples of reflection layers are described in JP-A-60-91354.

In a preferred multilayer construction, there are provided (in order from the side of exposure), a combination unit of a blue-sensitive emulsion, a combination unit of a green-sensitive emulsion, and a combination unit of a red-sensitive emulsion.

An arbitrary layer can be provided between the respective emulsion layer units to meet specific needs. In particular, an intermediate layer is preferably provided in order to prevent the unfavorable affection that an effect caused by development of one layer is extended to other emulsion layer units.

Where a developing agent is used in combination with a non-diffusible dye image-forming material, the intermediate layer preferably contains a non-diffusible reducing agent, in order to prevent the diffusion of the oxidation product of the developing agent. Such agents include, for example, non-diffusible hydroquinone, sulfonamidophenol, and sulfonamidonaphthol. More specifically, such non-diffusible reducing agents are described in JP-B-50-21249 and JP-B-50-23813, JP-A-49-106329 and JP-A-49-129535, U.S. Pat. Nos. 2,336,327, 2,360,290, 2,403,721, 2,544,640, 2,732,300, 2,782,659, 2,937,086, 3,637,393, and 3,700,453, British Patent 557,750, and JP-A-57-24941 and JP-A-58-21249. The methods for dispersing them are described in JP-A-60-238831 and JP-B-60-18978.

Where compounds releasing diffusible dyes with a silver ion are used, as described in JP-B-55-7576, compounds capturing the silver ion are preferably incorporated into an intermediate layer.

In the present invention, an anti-irradiation layer, a UV absorbing layer and a protective layer may also be provided depending on need.

F) Peeling Layer

In the present invention, a peeling layer can be provided, if needed, so that, after processing an arbitrary portion of a light-sensitive sheet in the unit may be peeled off. Accordingly, this peeling layer has to be readily peeled off after processing. There can be used as the material for this purpose, the compounds which, for example, are described in JP-A-47-8237, JP-A-59-220727, JP-A-59-229555, and JP-A-49-4653, U.S. Pat. Nos. 3,220,835 and 4,359,518, JP-A-49-4334, JP-A-56-65133, and JP-A-45-24075, and U.S. Pat. Nos. 3,227,550, 2,759,825, 4,401,746, and 4,366,227. Water soluble (or alkali soluble) cellulose derivatives can be cited as examples thereof. Available materials for this purpose include, for example, hydroxyethyl cellulose, cellulose acetate phthalate, plasticized methyl cellulose, ethyl cellulose, cellulose nitrate, and carboxymethyl cellulose. Available as other examples are various natural high polymers, for example, alginic acid, pectin, and gum arabic. There can also be used various modified gelatins, for example, acetylized gelatin, and phthalized gelatin. Further, water soluble synthetic polymers are other examples, including polyvinyl alcohol, polyacrylate, polymethyl methacrylate, polybutyl methacrylate, and copolymers thereof.

The peeling layer may consist of either a single layer or plural layers such as are described in JP-A-59-220727 and JP-A-60-60642.

II. Cover Sheet

In the present invention, in order to evenly spread a processing solution on a light-sensitive element and neutralize alkali, after processing to stabilize an image, a transparent cover sheet is used which has a layer (a neutralization layer, and a neutralization timing layer) having a neutralizing function.

G) Support

Any suitable material can be used as a support for the cover sheet used in the present invention as long as it is a flat and transparent support such as is usually used for photographic light-sensitive materials. Examples are sheets of cellulose acetate, polystyrene, polyethylene terephthalate, and polycarbonate; a subbing layer is preferably provided.

A trace amount of a dye is preferably incorporated into the support in order to prevent light piping.

H) Layer Having Neutralizing Function

The layer having a neutralizing function used in the present invention is a layer containing an acid material in an amount sufficient to neutralize alkali carried over from a processing composition; it may also be of a multilayer construction comprising a neutralizing speed controlling layer (a timing layer), and an adhesiveness strengthening layer, as may be needed. The preferred acid material is a material containing an acid group having a pKa of 9 or less (or a precursor group giving such an acid group by hydrolysis). Specific, preferred materials include higher fatty acids, such as, oleic acid, as described in U.S. Pat. No. 2,983,606, and polymers of acrylic acid, methacrylic acid, or maleic acid, and the partially esterified or acid anhydride polymer thereof, as disclosed in U.S. Pat. No. 3,362,819; copolymers of acrylic acid and acrylic acid esters, as disclosed in French Patent 2,290,699; and latex type acid polymers, as disclosed in U.S. Pat. No. 4,139,383 and *Research Disclosure* No. 16102 (1977).

In addition to the above, there can also be cited as example the acid materials disclosed in U.S. Pat. No. 4,088,493, and JP-A-52-153739, JP-A-53-1023, JP-A-53-4540, JP-A-53-4541, and JP-A-53-4542.

Concrete examples of the acid polymer include copolymers of a vinyl monomer, such as, ethylene, vinyl acetate, and vinyl methyl ether, and maleic acid anhydride, and the n-butyl ester thereof, copolymers of butyl acrylate and acrylic acid, cellulose, and acetate hydrogen phthalate.

The above polymers can be used in mixtures with hydrophilic polymers. Such polymers include polyacrylamide, polymethyl pyrrolidone, polyvinyl alcohol (including a partially saponified polymer), carboxymethyl cellulose, hydroxymethyl cellulose, hydroxyethyl cellulose, and polymethylvinyl ether. Of the foregoing, polyvinyl alcohol is preferred.

Polymers, other than hydrophilic polymers, for example, cellulose acetate, may be mixed with the above acid polymers.

The amount of the acid polymer coated on the layer is regulated by the amount of alkali spread in the light-sensitive element. An equivalent ratio per unit area of acid polymer to alkali is preferably 0.9 to 2.0. Too small an amount of acid polymer changes the hue of a transferred dye, and causes stain on a white background. Meanwhile, an excessive amount thereof causes inconveniences, such as, a change in hue, and reduction in light resistance. More preferably the equivalent ratio is 1.0 to 1.3. If an excessive amount or too small an amount of hydrophilic polymer is mixed the quality of the resulting photograph also deteriorates. The weight ratio of the hydrophilic polymer to the acid polymer is 0.1 to 10, and preferably, 0.3 to 3.0.

In the present invention, additives can be incorporated into the layer having a neutralizing function for various purposes. For example, there can be added hardeners, which are known to the person of an ordinary skill in the art, for the purpose of hardening, and polyhydric hydroxyl compounds, such as, polyethylene glycol, polypropylene glycol, and glycerine may be added in order to make the layer less fragile. In addition to the above, there also can be added, as needed, an antioxidation agent, a brightening agent, and a development inhibitor, or a precursor thereof.

Useful for a timing layer which is used in combination with neutralizing layer are, for example, polymers which lower alkali permeability, such as, gelatin, polyvinyl alcohol, partially acetalized polyvinyl alcohol, cellulose acetate, and partially hydrolyzed polyvinyl acetate; a latex polymer which is prepared by copolymerizing a small amount of a hydrophilic comonomer, such as, an acrylic acid monomer, and which increases the activation energy for alkali permeation; and a polymer having a lactone ring.

Above all, particularly useful are timing layers in which cellulose acetate is used, as is disclosed in JP-A-54-136328, and U.S. Pat. Nos. 4,267,262, 4,009,030, and 4,029,849; latex polymers prepared by copolymerizing a small amount of a hydrophilic comonomer, such as, acrylic acid, as disclosed in JP-A-54-128335, JP-A-56-69629, and JP-A-57-6843, and U.S. Pat. Nos. 4,056,394, 4,061,496, 4,199,362, 4,250,243, 4,256,827, and 4,268,604; polymers having a lactone ring, as are disclosed in U.S. Pat. No. 4,229,516; and in addition, polymers as are disclosed in JP-A-56-25735, JP-A-56-97346, and JP-A-57-6842, and European Patents 31,957A1, 37,724A1, and 48,412A1.

In addition to the above compounds, those described in the following publications can be used as well: U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, German Patent Application (OLS) Nos. 1,622,936 and 2,162,277, and *Research Disclosure* 15,162, No. 151 ( 1976 ).

The timing layer in which these materials are used may be a single layer or a combination of two or more layers.

It is possible to incorporate into the timing layer comprising the foregoing materials, additives, such as, for example, development inhibitors and/or precursors thereof, as are disclosed in U.S. Pat. No. 4,009,029, German Patent Application (OLS) Nos. 2,913,164, and 3,014,672, and JP-A-54-155837 and JP-A-55-138745; the hydroquinone precursors disclosed in U.S. Pat. No. 4,201,578; and the other photographically useful additives or precursors thereof.

Further, an auxiliary neutralizing layer can be provided as a neutralizing layer as is described in JP-A-63-168468 and JP-A-63-168649, which is effective in lowering the change in transfer density attributable to aging, after processing.

I) Others

In addition to the layer(s) having a neutralizing function, there may be provided as a layer having an auxiliary function, a back layer, a protective layer, a capturing mordant layer, and a filter dye layer.

The back layer is provided in order to adjust curling, and provide lubrication. A filter dye may be added to this layer.

The protective layer is used mainly for the purpose of preventing adhesion to the back face of a cover sheet, and adhesion to the protective layer of a light-sensitive material, when the light-sensitive material and cover sheet are superposed.

In the capturing mordant layer, a dye which is diffused to the alkali processing composition side can be captured, to prevent delay in the time of dye image formation and to prevent deterioration in sharpness. A dye capturing layer is usually provided on the outermost layer of the cover sheet. The dye capturing layer may contain a polymer mordant in hydrophilic colloid, as well as the above dye receiving layer, and such a layer is described in JP-A-l-198747, and JP-A-2-282253.

A dye can be incorporated into the cover sheet to control the sensitivity of the light-sensitive layer. A filter dye may be added directly to the support of the cover sheet, to the layer having- a neutralizing function, and further to the above back layer, protective layer, and capturing mordant layer, or to an independent layer for containing the dye.

There can be incorporated into any of the light-sensitive sheet, cover sheet, and alkali processing composition, development accelerators, described at pages 72 to 91, hardeners, described at pages 146 to 155, surface active agents, described at pages 201 to 210, fluorine-containing compounds, described at pages 210 to 222, thickeners, described at pages 225 to 227, antistatic agents, described at pages 227 to 230, polymer latexes, described at pages 230 to 239, and matting agents, described at page 240, all as described at the cited pages of JP-A-62-215272.

III. Alkali Processing Composition

The processing composition used in the present invention is uniformly spread on a light-sensitive element, after the light-sensitive element is exposed, and is paired with a light shielding layer, provided on the back side of a support, or the side opposite the processing solution on a light-sensitive layer, to completely shield the light-sensitive layer from light coming from the outside. In addition, the processing composition develops the light-sensitive layer with the components contained therein. For this purpose, the composition contains alkali, a thickener, a light shielding agent, a developing agent, a developing accelerator, and a developing inhibitor, each used for adjusting development, and an anti-oxidation agent, used for preventing the developing agent from deteriorating. A light shielding agent is also contained in the composition without fail.

Alkali should be used in an amount sufficient to adjust the pH to from 12 to 14; suitable alkalis include the hydroxides of alkali metals (for example, sodium hydroxide, potassium hydroxide and lithium hydroxide), phosphates of alkali metals (for example, potassium phosphate), guanidines, and hydroxides of quaternary amines (for example, tetramethylammonium hydroxide). Of these, potassium hydroxide, and sodium hydroxide are preferred.

A thickener is necessary for uniformly spreading the processing solution and for maintaining adhesiveness between the light-sensitive layer and the cover sheet. Useful thickeners include, for example, polyvinyl alcohol, hydroxyethyl cellulose, and an alkali metal salt of carboxyethyl cellulose. Hydroxyethyl cellulose, and sodium carboxyethyl cellulose are preferably used.

As the light shielding agent, either a dye or pigment, or the combination thereof, can be used as long as it is not diffused into a dye image-receiving layer to generate a stain. Carbon black can be cited as the typical light shielding agent.

Any developing agent can be used, as long as it cross-oxides a dye image-forming material, and does not substantially generate a stain by oxidation. A developing agent may be used alone, or in combinations of two or more kinds, or in the form of a precursor. These developing agents may be contained in a suitable layer of a light-sensitive element, or in an alkaline processing solution. Examples of useful compounds include aminophenols, and pyrazolidinones. Of these, pyrazolidinones are particularly preferred, because they are less prone to generate stain.

Specific useful compounds include, for example, 1-phenyl-3-pyrazolidinone, 1-p-tolyl-4,4-dihydroxymethyl-3-pyrazolidinone, 1-(3'-methylphenyl)-4-methyl-4-hydroxymethy-3-pyrazolidinone, 1-phenyl-4-methyl-4-hydroxymethyl-3-pyrazolidinone, and 1-p-tolyl-4-methyl-4-hydroxymethyl-3-pyrazolidinone.

EXAMPLES

The present invention will now be explained concretely with reference to the following examples, but the invention is not limited thereto.

Example 1

First, the preparation method for the silver halide emulsion will be explained.

Eight kinds of silver halide emulsions (Emulsion 1 to Emulsion 8) shown in Table 1 were prepared according to the emulsion grain preparation method shown below.

TABLE 1

| Emulsion Grains Prepared | | |
|---|---|---|
| Emulsion No. | Grain Size | Diameter/ thickness |
| Emulsion 1 | Monodisperse octahedral grain with diameter of 1.40 μm | 1 |
| Emulsion 2 | monodisperse octahedral grain with diameter of 1.40 μm | 1 |
| Emulsion 3 | monodisperse octahedral grain with diameter of 1.40 μm | 1 |
| Emulsion 4 | Monodisperse octahedral grain with diameter of 1.40 μm | 1 |
| Emulsion 5 | Tabular grain with thickness of 0.34 μm and diameter of 2.32 μm | 6.8 |
| Emulsion 6 | Tabular grain with thickness of 0.59 μm and diameter of 1.76 μm | 3.0 |
| Emulsion 7 | Tabular grain with thickness of 0.34 μm and diameter of 2.32 μm | 6.8 |
| Emulsion 8 | Tabular grain with thickness of 0.77 μm and diameter of 1.54 μm | 2.0 |

Preparation of Emulsion 1

(Octahedral Internal Latent Image Type Direct Positive Emulsion)

A 0.4M silver nitrate aqueous solution and a 0.4M potassium bromide aqueous solution were added to a 8 weight % gelatin aqueous solution 1000 ml containing 13 g of potassium bromide, and 1.3 g of the silver halide solvent S-(13), by a controlled double jet method, while maintaining the temperature at 75° C., wherein the silver nitrate aqueous solution 300 ml was added over a period of 40 minutes, while controlling the addition speed of the potassium bromide aqueous solution so that pBr was maintained at 1.30.

After completing the addition, there were formed octahedral silver bromide grains (hereinafter referred to as core grains) having a uniform grain size with an average grain size (a sphere-corresponding diameter) of 0.8 μm.

Next, 0.7 mg of sodium thiosulfate, and 0.4 mg of potassium chloraurate (each was added in the form of a solution) were added to the silver bromide grains prepared above, and the emulsion was heated at 75° C. for 80 minutes thereby to subject it to chemical sensitization processing. Then, 20 g of solid adsorbing agent (MCI GEL CHP-20P, manufactured by Mitsubishi Chemicals Ind. Co., Ltd.) was added thereto, and stirred for 30 minutes. A 0.8M silver nitrate aqueous solution, and a 0.8M potassium bromide aqueous solution, were added to the core grains thus subjected to the chemical sensitization, and solid adsorbing agent addition treatment by a double jet method, while maintaining the temperature at 75° C.; the silver nitrate aqueous solution 740 ml was added over the period of 60 minutes, while controlling the addition speed of the potassium bromide aqueous solution, so that pBr was maintained at 1.30.

This emulsion was washed with water by a conventional flocculation method, and immediately after adding gelatin, the emulsion was filtrated with a microfilter having the pore size of 10 μm, to separate the solid adsorbing agent from the emulsion. Thus, there were obtained the octahedral silver bromide grains (hereinafter referred to as internal latent image type core/shell grains) having a uniform grain size with an average grain size (a sphere-corresponding diameter) of 1.4 μm.

Next, 0.4 mg of sodium thiosulfate, and 20 mg of poly(N-vinyl pyrrolidone), each per mole of silver, were added to the internal latent image type core/shell emulsion prepared above, and the emulsion was heated at 60° C. for 60 minutes to thereby subject the grain surface to chemical sensitization, whereby the octahedral internal latent image type direct positive emulsion was prepared.

Preparation of Emulsion 5

(Hexagonal Tabular Internal Latent Image Type Direct Positive Emulsion)

25 ml of 2M silver nitrate aqueous solution containing gelatin, and 25 ml of 2M potassium bromide aqueous solution containing gelatin, were simultaneously added to 1 liter of a 0.7 weight % gelatin aqueous solution containing 0.04M potassium bromide, for 1 minute, by the double jet method, while vigorously stirring. During this time, the gelatin solution was maintained at 30° C. After completing the addition, the temperature was raised to 75° C., and 300 ml of a 10 weight % gelatin solution was added.

Next, 20 ml of a 1M silver nitrate aqueous solution was added, over a period of 5 minutes, and then a 25 weight % ammonia aqueous solution was added to carry out a ripening at 75° C. After completing the ripening, ammonia was neutralized, and then a 1M silver nitrate aqueous solution, and a 1M potassium bromide aqueous solution were added, at an accelerated flow speed (the flow speed at termination was four times as fast as that at the beginning) by the double jet method, while maintaining pBr at 2.5 (the amount of silver nitrate aqueous solution consumed was 600 ml).

The grains thus formed (hereinafter referred to as a core grains) were washed with water by a conventional flocculation method, and gelatin was added, whereby 800 g of hexagonal tabular core grains were obtained.

The hexagonal tabular core grains thus obtained had an average projected area circle-corresponding diameter of 1.0 μm, and an average thickness of 0.21 μm, and 95% of the whole projected area was shared by the hexagonal tabular core grains.

Next, 750 ml of water and 30 g of gelatin were added to the above hexagonal tabular core emulsion 250 g, and, after raising the temperature to 75° C., the silver halide solvent S-(13) 0.5 g, 0.8 mg of sodium thiosulfate and 0.4 mg of potassium chloraurate (each was added in the form of an aqueous solution) were added to the above hexagonal tabular core emulsion, and the emulsion was heated at 75° C. for 80 minutes to thereby subject it to chemical sensitization processing. Then, 20 g of solid adsorbing agent (MCI GEL CHP-20P, manufactured by Mitsubishi Chemicals Ind. Co., Ltd.) was added thereto, and stirred for 30 minutes. A 2M silver nitrate aqueous solution and a 2.5M potassium bromide aqueous solution were added to the core grains thus subjected to the chemical sensitization and the solid adsorbing agent addition treatment at an accelerated flow speed (a flow speed at a termination was five times as fast as that at a beginning) by the double jet method (the amount of silver nitrate aqueous solution consumed was 810 ml).

This emulsion was washed with water by a conventional flocculation method, and immediately after adding gelatin, the emulsion was filtrated with a microfilter having a pore size of 10 μm, to separate the solid adsorbing agent from the emulsion. Thus, the hexagonal tabular internal latent image type core/shell emulsion was obtained. The hexagonal tabular grains thus obtained had an average projected area circle-corresponding diameter of 2.3 μm, an average thickness of 0.34 μm, and an average volume size of 14 $(\mu m)^3$ and 88% of the whole projected area was shared by the hexagonal tabular grains.

Next, 0.45 mg of sodium thiosulfate, and 15 mg of poly(N-vinyl pyrrolidone), each per mole of silver, were added to the hexagonal tabular internal latent image type core/shell emulsion, and the emulsion was heated at 60° C. for 60 minutes to thereby subject the grain surface to chemical sensitization, whereby the hexagonal tabular internal latent image type direct positive emulsion was prepared.

Emulsions 2 to 4 were prepared in the same manner as that of Emulsion 1, except that the silver halide solvent or solid adsorbing agent addition treatment was changed in the preparation of Emulsion 1, and Emulsions 6 to 8 were prepared as Emulsion 5, except that the silver halide solvent or solid adsorbing agent addition treatment was changed in the preparation of Emulsion 5. The preparation methods are summarized and shown in Table 2.

TABLE 2

| | Emulsion Preparation Methods | | | |
|---|---|---|---|---|
| | Silver Halide. Solvent | | Solid Adsorbing Agent Addition | |
| Emulsion No. | No. | Added amount | Agent | Added amount |
| Emulsion 1 (Inv.) | S-(13) | 1.30 g | CHP-20P | 20 g |
| Emulsion 2 (Comp.) | S-(13) | 1.30 g | — | — |
| Emulsion 3 (Inv.) | S-(38) | 0.05 g | CHP-20P | 20 g |
| Emulsion 4 (Comp.) | S-(38) | 0.05 g | — | — |
| Emulsion 5 (Inv.) | S-(13) | 0.50 g | CHP-20P | 20 g |
| Emulsion 6 (Comp.) | S-(13) | 0.50 g | — | — |
| Emulsion 7 (Inv.) | S-(38) | 0.50 g | CHP-20P | 20 g |
| Emulsion 8 (Comp.) | S-(38) | 0.50 g | — | — |

These emulsions were used to prepare the comparative light-sensitive element (Sample 101) and light-sensitive elements of the present invention, each having the construction shown in Table 3.

TABLE 3

| Construction of Comparative Light-Sensitive Element 101 | | | |
|---|---|---|---|
| Layer No. | Layer Name | Additive | Coated Amount (g/cm²) |
| 18th layer | Protective layer | Gelatin | 1.00 |
| | | Matting agent (1) | 0.25 |
| 17th layer | UV absorbing layer | Gelatin | 0.50 |
| | | UV absorber (1) | $4.0 \times 10^{-4}$ |

TABLE 3-continued

| Construction of Comparative Light-Sensitive Element 101 | | | |
|---|---|---|---|
| Layer No. | Layer Name | Additive | Coated Amount (g/cm²) |
| | | UV absorber (2) | $4.0 \times 10^{-4}$ |
| 16th layer | Yellow-sensitive layer | Emulsion 2 as Ag | 0.90 |
| | | Sensitizing dye (3) | $2.1 \times 10^{-3}$ |
| | | Nucleus forming agent (1) | $1.0 \times 10^{-7}$ |
| | | Additive (2) | 0.05 |
| | | Gelatin | 1.10 |
| 15th layer | White color reflection layer | Titanium dioxide | 0.70 |
| | | Gelatin | 0.18 |
| 14th layer | Yellow color material layer | Yellow dye-releasing compound (1) | 0.53 |
| | | High boiling organic solvent (1) | 0.13 |
| | | Additive (1) | $1.4 \times 10^{-2}$ |
| | | Gelatin | 0.70 |
| 13th layer | Intermediate layer | Gelatin | 0.30 |
| 12th layer | Anti-color mixing Layer | Additive (1) | 0.80 |
| | | Polymethyl methacrylate | 0.80 |
| | | Gelatin | 0.45 |
| 11th layer | Green-sensitive layer | Emulsion 2 as Ag | 1.20 |
| | | Sensitizing dye (2) | $3.2 \times 10^{-3}$ |
| | | Nucleus forming agent (1) | $3.8 \times 10^{-8}$ |
| | | Additive (2) | 0.12 |
| | | Gelatin | 1.50 |
| 10th layer | White color reflection layer | Titanium dioxide | 1.00 |
| | | Gelatin | 0.25 |
| 9th layer | Magenta color material layer | Magenta dye-releasing compound (1) | 0.50 |
| | | High boiling organic solvent (1) | 0.10 |
| | | Additive (1) | $9.0 \times 10^{-3}$ |
| | | Gelatin | 0.90 |
| 8th layer | Intermediate layer | Gelatin | 0.30 |
| 7th layer | Anti-color mixing layer | Additive (1) | 1.20 |
| | | Polymethyl methacrylate | 1.20 |
| | | Gelatin | 0.70 |
| 6th layer | Red-sensitive layer | Emulsion 2 as Ag | 0.75 |
| | | Sensitizing dye (1) | $9.3 \times 10^{-4}$ |
| | | Nucleus forming agent (1) | $7.5 \times 10^{-8}$ |
| | | Additive (2) | 0.06 |
| | | Gelatin | 1.20 |
| 5th layer | White color reflection layer | Titanium dioxide | 3.00 |
| | | Gelatin | 0.80 |
| 4th layer | Cyan color material layer | Cyan dye-releasing compound (1) | 0.50 |
| | | High boiling organic solvent (1) | 0.10 |
| | | Additive (1) | 0.01 |
| | | Gelatin | 1.0 |
| 3rd layer | Opaque layer | Carbon black | 1.70 |
| | | Gelatin | 1.70 |
| 2nd layer | White color reflection layer | Titanium dioxide | 22.00 |
| | | Gelatin | 2.75 |
| 1st layer | Image-receiving | Polymer mordant agent (1) | 3.00 |
| | | Gelatin | 3.00 |
| Support (polyethylene terephthalate 150 μm) | | | |

The following compounds were used for the indicated functions:

Polymer Mordant Agent (1)

-continued
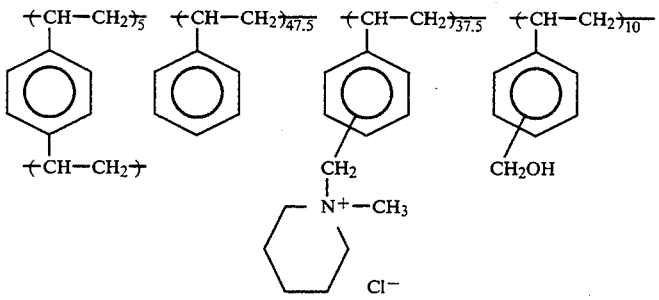
Uv Absorber (1)
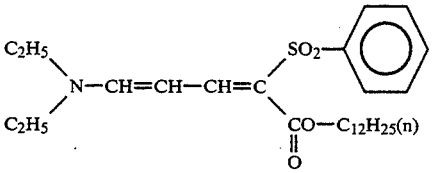
UV Absorber (2)
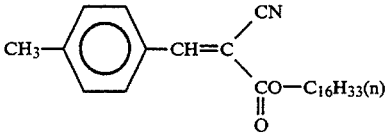
Matting Agent (1)
Polymethyl methacrylate spherical latex (average grain size: 4 μm)
Cyan Dye-Releasing Compound (1)
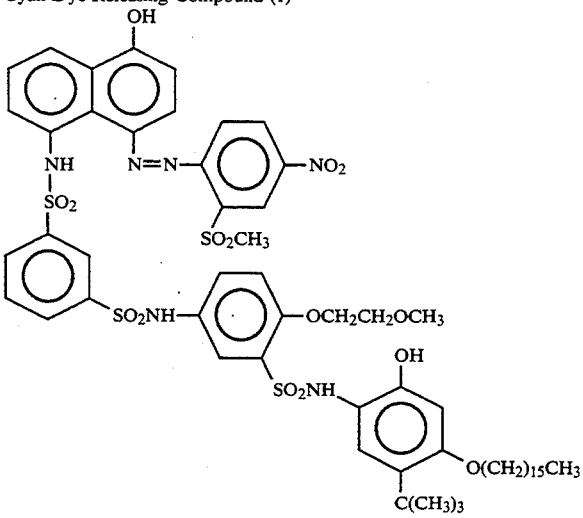
Magenta Dye-Releasing Compound (1)
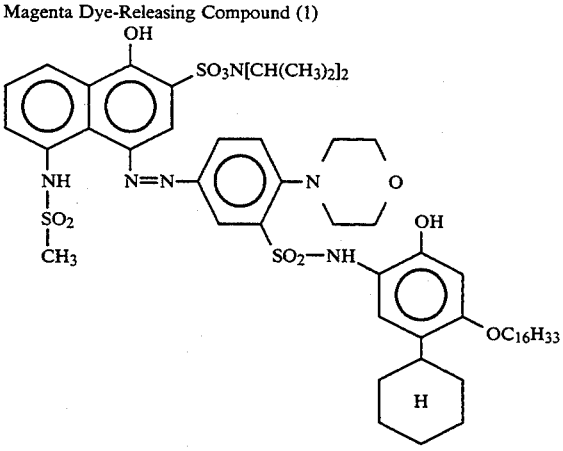

-continued
Yellow Dye-Releasing Compound (1)
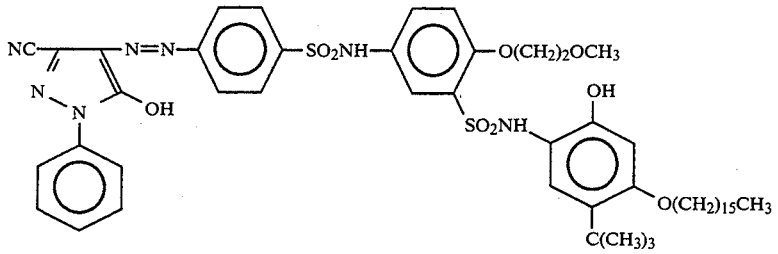
Additive (1)
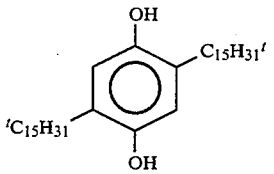
Additive (2)
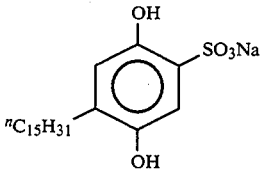
High Boiling Organic Solvent (1)
Tricyclohexyl phosphate
Nucleus Forming Agent (1)
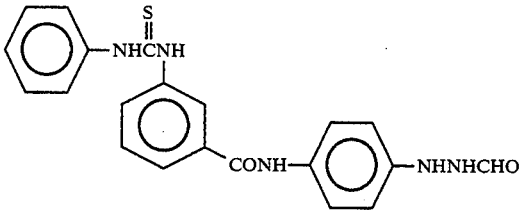
Sensitizing Dye (1)
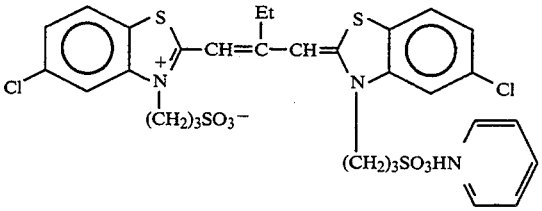
Sensitizing Dye (2)
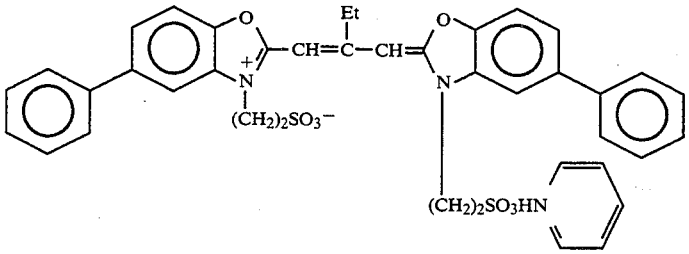
Sensitizing Dye (3)

-continued

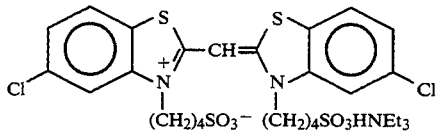

The cover sheet was prepared as follows:

The following layers were coated on a polyethylene terephthalate transparent support, subbed with gelatin, and containing an anti-light piping dye:

(1) A neutralizing layer containing 10.4 g/m$^2$ of an acrylic acid—butyl acrylate copolymer (mole ratio 8:2) having an average molecular weight of 50,000, and 0.1 g/m$^2$ of 1,4-bis(2,3-epoxypropoxy)butane.

(2) A neutralization timing layer containing 4.3 g/m$^2$ of acetyl cellulose having the acetylation degree of 51% and 0.2 g/m$^2$ of poly(methyl vinyl ether-comonomethyl maleate).

(3) A layer containing 2.5 g/m$^2$ of the blend of whole solid matter consisting of a polymer latex prepared by emulsion-polymerizing styrene, butyl acrylate, acrylic acid, and N-methylolacrylamide in a weight ratio of 49.7:42.3:4:4, and a polymer latex prepared by emulsion-polymerizing methyl methacrylate, acrylic acid, and N-methylolacrylamide in a weight ratio of 93:3:4, wherein the polymer latexes were blended so that the solid matter ratio became 6:4.

(4) A layer containing 1 g/m$^2$ of gelatin.

The alkali processing composition was prepared in the following manner:

0.8 g of a processing solution of the following composition was charged into a pressure rupturable vessel:

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzyl alcohol | 1.5 ml |
| Sodium carboxymethyl cellulose | 58 g |
| Carbon black | 150 g |
| Potassium hydroxide (a 28% aqueous solution) | 200 ml |
| Water | 680 ml |

0.8 g of the processing solution of the above composition was charged into each of general pressure rupturable vessels.

Next, the emulsions contained in the 16th layer, the 11th layer, and the 6th layer were replaced in order with Emulsions 1 to 8 as shown in Table 4, whereby Samples 102 to 111 were prepared.

TABLE 4

| | Emulsion Used | | |
|---|---|---|---|
| Sample No. | 6th layer (Red-sensitive layer) | 11th layer (Green-sensitive layer) | 16th layer (Blue-sensitive Layer) |
| 101 (Comp.) | Emulsion 2 (Comp.) | Emulsion 2 (Comp.) | Emulsion 2 (Comp.) |
| 102 (Inv.) | Emulsion 1 (Inv.) | Emulsion 2 (Comp.) | Emulsion 2 (Comp.) |
| 103 (Inv.) | Emulsion 3 (Inv.) | Emulsion 2 (Comp.) | Emulsion 2 (Comp.) |
| 104 (Comp.) | Emulsion 4 (Comp.) | Emulsion 2 (Comp.) | Emulsion 2 (Comp.) |
| 105 (Inv.) | Emulsion 5 (Inv.) | Emulsion 2 (Comp.) | Emulsion 2 (Comp.) |
| 106 (Comp.) | Emulsion 6 (Comp.) | Emulsion 2 (Comp.) | Emulsion 2 (Comp.) |
| 107 (Inv.) | Emulsion 7 (Inv.) | Emulsion 2 (Comp.) | Emulsion 2 (Comp.) |
| 108 (Comp.) | Emulsion 8 (Comp.) | Emulsion 2 (Comp.) | Emulsion 2 (Comp.) |
| 109 (Comp.) | Emulsion 6 (Comp.) | Emulsion 6 (Comp.) | Emulsion 6 (Comp.) |
| 110 (Inv.) | Emulsion 1 (Inv.) | Emulsion 1 (Inv.) | Emulsion 1 (Inv.) |
| 111 (Inv.) | Emulsion 5 (Inv.) | Emulsion 5 (Inv.) | Emulsion 5 (Inv.) |

The above light-sensitive elements 101 to 111 were exposed from the emulsion layer side via a gray filter. They were then superposed on the above cover sheets, and the above processing solution was spread between both the materials with a pressurized roller, so that the solution was spread in a thickness of 75 μm. The processing was carried out to 25° C. The transferred densities were measured with a color densitometer 10 minutes later. The results thereof are shown in Table 5.

TABLE 5

| | Measurement Results of Maximum Density, Minimum Density, and Relative Sensitivity | | | | | | | | |
|---|---|---|---|---|---|---|---|---|---|
| | Max. Density | | | Min. Density | | | Relative S* | | |
| Sample No. | Y | M | Cy | Y | M | Cy | Y | M | Cy |
| 101 (Comp.) | 2.10 | 2.25 | 2.40 | 0.31 | 0.33 | 0.32 | 100 | 100 | 100 |
| 102 (Inv.) | 2.08 | 2.20 | 2.35 | 0.30 | 0.32 | 0.25 | 105 | 103 | 125 |
| 103 (Inv.) | 2.09 | 2.21 | 2.36 | 0.29 | 0.32 | 0.27 | 104 | 105 | 120 |
| 104 (Comp.) | 2.11 | 2.26 | 2.42 | 0.30 | 0.34 | 0.33 | 99 | 100 | 97 |
| 105 (Inv.) | 2.10 | 2.23 | 2.38 | 0.29 | 0.31 | 0.26 | 106 | 105 | 160 |
| 106 (Comp.) | 2.09 | 2.23 | 2.41 | 0.32 | 0.33 | 0.32 | 101 | 98 | 108 |
| 107 (Inv.) | 2.07 | 2.25 | 2.35 | 0.30 | 0.31 | 0.26 | 104 | 101 | 158 |
| 108 (Comp.) | 2.09 | 2.25 | 2.38 | 0.31 | 0.34 | 0.32 | 100 | 102 | 105 |
| 109 (Comp.) | 2.07 | 2.28 | 2.38 | 0.31 | 0.32 | 0.32 | 103 | 108 | 100 |
| 110 (Inv.) | 2.05 | 2.23 | 2.37 | 0.26 | 0.28 | 0.26 | 120 | 125 | 128 |

TABLE 5-continued

| | Measurement Results of Maximum Density, Minimum Density, and Relative Sensitivity | | | | | | | | |
|---|---|---|---|---|---|---|---|---|---|
| | Max. Density | | | Min. Density | | | Relative S* | | |
| Sample No. | Y | M | Cy | Y | M | Cy | Y | M | Cy |
| 111 (Inv.) | 2.06 | 2.22 | 2.35 | 0.26 | 0.27 | 0.26 | 127 | 153 | 165 |

*"Relative S" is relative sensitivity, i.e., a value (anti-logarithm) relative to the sensitivity at a density of 1.0 of each layer in Sample 101, which is set at 100.

It can be found from the results shown in Table 5 that the present invention can provide images having low minimum density, with a high sensitivity, and that particularly in Samples No. 105, 107 and 111, the present invention enables tabular grains having a high grain diameter/thickness to be prepared, and allows a particularly high sensitivity performance to be obtained.

While the invention has been described in detail and with reference to specific embodiments thereof, it will be apparent to one skilled in the art that various changes and modifications can be made therein without departing from the spirit and scope of this invention.

What is claimed is:

1. An internal latent image type direct positive silver halide emulsion prepared by i) subjecting a silver halide grain, which forms an internal nucleus, to chemical sensitization in the presence of an organic silver halide solvent, and by ii) adding a porous organic synthetic resin having no ion exchange group, before finishing the formation of an outer shell silver halide phase, to remove a part or all of the silver halide solvent.

2. The internal latent image type direct positive silver halide emulsion described in claim 1, containing a tabular silver halide grain having an average grain diameter of at least 0.3 μm, and a ratio of an average grain diameter to an average grain thickness of 2 or more, based on 50% or more of the total of silver halide grains.

3. A color diffusion transfer photographic film unit comprising (a) a light-sensitive sheet having an image-receiving layer, a white color reflection layer, a light shielding layer, and at least one silver halide emulsion layer, combined with at least one dye image-forming material, each provided on a transparent support, (b) a transparent cover sheet having at least a neutralizing layer, and a neutralization timing layer, each provided on a transparent support, and (c) a light shielding alkali processing composition to be spread between the above light-sensitive sheet and transparent cover sheet, wherein at least one layer of said silver halide emulsion layers contains an internal latent image type direct positive silver halide emulsion, prepared by i) subjecting a silver halide grain which forms an inner nucleus to a chemical sensitization in the presence of an organic silver halide solvent, and by ii) adding a porous organic synthetic resin having no ion exchange group, before finishing the formation of an outer shell silver halide phase, to remove a part or all of the silver halide solvent.

4. A color diffusion transfer photographic film unit as in claim 3, wherein the internal latent image type direct positive silver halide emulsion contains a tabular silver halide grain having an average grain diameter of at least 0.3 μm, and a ratio of an average grain diameter to an average grain thickness of 2 or more, based on 50% or more of the total silver halide grains.

* * * * *